US008385783B2

(12) United States Patent
Ohmura et al.

(10) Patent No.: US 8,385,783 B2
(45) Date of Patent: Feb. 26, 2013

(54) DEVELOPMENT DEVICE INCLUDING AN AGITATOR HAVING A LINEAR MEMBER, AND AN IMAGING FORMING APPARATUS INCLUDING THE DEVELOPMENT DEVICE

(75) Inventors: Tomoya Ohmura, Yokohama (JP); Junichi Matsumoto, Yokohama (JP); Natsumi Matsue, Ebina (JP)

(73) Assignee: Ricoh Company, Limited, Tokyo (JP)

( * ) Notice: Subject to any disclaimer, the term of this patent is extended or adjusted under 35 U.S.C. 154(b) by 467 days.

(21) Appl. No.: 12/621,028

(22) Filed: Nov. 18, 2009

(65) Prior Publication Data

US 2010/0124443 A1 May 20, 2010

(30) Foreign Application Priority Data

Nov. 20, 2008 (JP) ..... 2008-297358

(51) Int. Cl.
*G03G 15/08* (2006.01)

(52) U.S. Cl. ..... 399/254

(58) Field of Classification Search ..... 399/254, 399/258, 262, 263
See application file for complete search history.

(56) References Cited

U.S. PATENT DOCUMENTS 5,345,297 A * 9/1994 Katakabe et al. ..... 399/263
5,652,947 A 7/1997 Izumizaki
5,682,583 A 10/1997 Ito et al.
5,812,916 A * 9/1998 Kishimoto et al. ..... 399/263
5,835,827 A * 11/1998 Kishimoto ..... 399/254
5,835,828 A * 11/1998 Jyoroku ..... 399/256
6,246,854 B1 * 6/2001 Kurosawa et al. ..... 399/263
6,405,010 B2 * 6/2002 Ashikari et al. ..... 399/262
6,526,245 B1 * 2/2003 Yamashita ..... 399/254
6,882,816 B2 4/2005 Tamai
2007/0053721 A1 3/2007 Matsumoto et al.
2007/0053723 A1 3/2007 Iwata et al.
2007/0154242 A1 7/2007 Matsumoto et al.
2007/0166079 A1 7/2007 Ichikawa et al.
2007/0264053 A1 11/2007 Iwata et al.
2007/0274740 A1 11/2007 Katoh et al.
2008/0226349 A1 9/2008 Iwata et al.
2008/0298844 A1 12/2008 Katoh et al.
2008/0298845 A1 12/2008 Ohmura et al.
2008/0298866 A1 12/2008 Matsumoto et al.
2009/0028611 A1 1/2009 Matsumoto et al.
(Continued)

FOREIGN PATENT DOCUMENTS

JP 5-19620 1/1993
JP 9-218630 8/1997
(Continued)

OTHER PUBLICATIONS

U.S. Appl. No. 12/631,331, filed Dec. 4, 2009, Matsue, et al.

*Primary Examiner* — Quana M Grainger
(74) *Attorney, Agent, or Firm* — Oblon, Spivak, McClelland, Maier & Neustadt, L.L.P.

(57) ABSTRACT

A development device includes a development portion to develop a latent image formed on a latent image carrying member with developer including toner and carrier particles, a circulation unit to convey the developer collected from the development portion to development portion, the circulation unit including a container to store the developer, disposed upstream from the development portion in a direction in which the developer is circulated, and a first agitator provided inside the container, to agitate and mix the collected developer and fresh toner supplied to the container, the first agitator formed by multiple linear members.

18 Claims, 19 Drawing Sheets

U.S. PATENT DOCUMENTS

| | | | | |
|---|---|---|---|---|
| 2009/0087227 | A1 * | 4/2009 | Takagi et al. | 399/263 |
| 2009/0123174 | A1 | 5/2009 | Iwata et al. | |
| 2009/0317106 | A1 | 12/2009 | Ohmura et al. | |

FOREIGN PATENT DOCUMENTS

| | | |
|---|---|---|
| JP | 11-143196 | 5/1999 |
| JP | 2001-188408 | 7/2001 |
| JP | 3349286 | 9/2002 |
| JP | 2003-241498 | 8/2003 |
| JP | 2004-191882 | 7/2004 |
| JP | 2008-3560 | 1/2008 |

* cited by examiner

FIG. 12A
| | END PORTION | | | CENTER | | |
|---|---|---|---|---|---|---|
| sec | TC | Q/M | DA | TC | Q/M | DA |
| 3 | 7.653 | 30.93 | 33.81533 | 6.225 | 33.4 | 29.70214 |
| 6 | 7.631 | 31.79 | 34.65564 | 5.411 | 43.66 | 33.74918 |
| 10 | 7.628 | 32.82 | 35.76442 | 6.721 | 34.02 | 32.66406 |
| 15 | 7.519 | 33.11 | 35.56487 | 6.702 | 35.16 | 33.66319 |
| 30 | 6.857 | 36.43 | 35.68579 | 6.902 | 36.55 | 36.0383 |
| 60 | 7.313 | 35.62 | 37.21272 | 6.932 | 38.74 | 38.36367 |
FIG. 12B
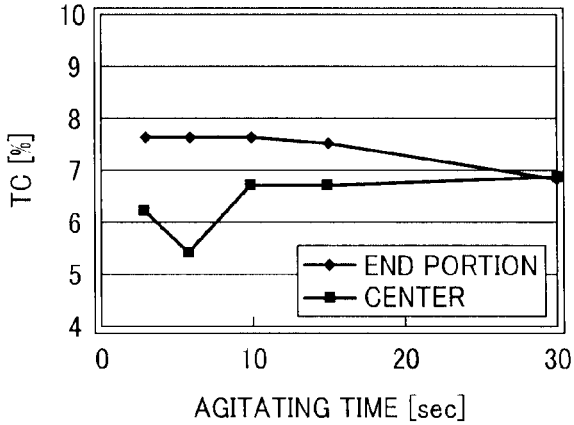
FIG. 12C
| | END PORTION | | | CENTER | | |
|---|---|---|---|---|---|---|
| sec | TC | Q/M | DA | TC | Q/M | DA |
| 3 | 7.687 | 31.28 | 34.34991 | 7.08 | 33.39 | 33.7716 |
| 6 | 7.24 | 34.37 | 35.5484 | 7.213 | 31.8 | 32.76763 |
| 10 | 7.191 | 33.68 | 34.59898 | 7.171 | 32.28 | 33.06855 |
| 15 | 7.42 | 35.23 | 37.3438 | 7.207 | 36.1 | 37.16753 |
| 30 | 7.193 | 34.45 | 35.39984 | 7.257 | 34.31 | 35.56967 |
| 60 | 7.165 | 33.48 | 34.26917 | 7.208 | 33.6 | 34.5984 |
FIG. 12D
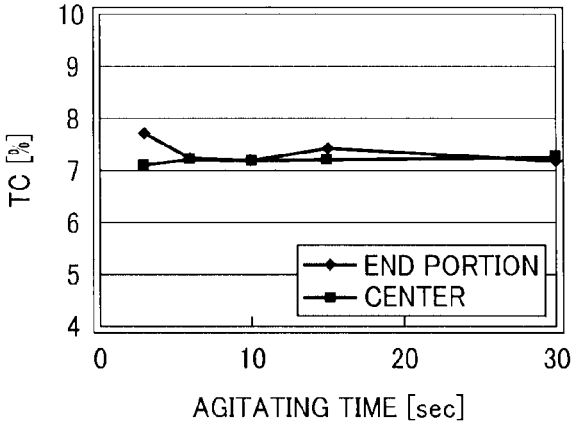

DEVELOPMENT DEVICE INCLUDING AN AGITATOR HAVING A LINEAR MEMBER, AND AN IMAGING FORMING APPARATUS INCLUDING THE DEVELOPMENT DEVICE

CROSS-REFERENCE TO RELATED APPLICATIONS

This patent specification claims priority from Japanese Patent Application No. 2008-297358, filed on November 20, in the Japan Patent Office, the entire contents of which are hereby incorporated by reference herein.

BACKGROUND OF THE INVENTION

1. Field of the Invention

The present invention relates to a development device and an image forming apparatus including the same, and more particularly, to a development device using two-component developer and an image forming apparatus using the same.

2. Discussion of the Background

Electrophotographic image forming apparatuses such as copiers, printers, facsimile machines, plotters, multi-function machines, or the like typically include a development device and a transfer unit. The development device develops a latent image formed on a photoreceptor serving as a latent image carrying member into a visible toner image. The transfer unit transfers the toner image from the photoreceptor onto a recording medium (e.g., transfer sheet) to form an image on the recording medium.

At present, the development device develops latent images into toner images using either one-component developer or two-component developer. The one-component developer consists of magnetic or non-magnetic toner. On the other hand, the two-component developer includes toner and carrier particles for carrying the toner. The development device develops the latent image formed on the latent image carrying member with the developer including the toner and the carrier.

The developer is agitated and mixed inside the development device using the two-component developer, at which time the toner is charged by friction generated between the toner and the carrier and then electrostatically attracted to the electrostatic latent image formed on the latent image carrying member, thereby forming a toner image.

In general, the development device includes a magnetic developer carrier such as a development sleeve and an agitator such as an agitation paddle or an agitation screw to agitate and mix the developer. The developer magnetically carried on the developer carrier is supplied to the surface of the latent image carrying member carrying an electrostatic latent image to develop the electrostatic latent image into a toner image with developer. The agitator agitates and mixes the developer to generate the frictional charge between the toner and carrier, and then supplies the developer carrier with the developer. The developer whose toner has been consumed in the development process of the latent image on the latent image carrying member is collected to the development device.

In certain related-art image forming apparatuses, the toner and the carrier are agitated in a dedicated agitation mechanism solely for agitating provided separately from the development device, and the agitation mechanism can be installed and replaced independently of the development device.

More specifically, one known image forming apparatus includes a development device including a transport screw provided with an auger as an agitation sleeve. Toner can be supplied from the top of the screw or from an axial end portion of the transport screw so that the toner is poured on the transport screw.

It is to be noted that the toner included in the developer must be replenished periodically because it is consumed during the development process, and unless replenished the image density of the formed image declines. The amount of toner that is supplied is controlled by controlling a rotation amount of a supplying member that discharges the toner from a toner container to a developer container. That control, in turn, is executed based on readings from a detector such as a toner concentration sensor that measures the toner concentration in the developer. When the fresh toner thus supplied is poured into the developer container, the fresh toner is mixed with the carrier in the developer by the transport screw located close to the supplying member to maintain a constant toner concentration. At the same time, the toner is charged frictionally by such agitation, and the toner that is charged a predetermined amount by friction is supplied to the development sleeve.

In the above-described configuration, in the developer agitating process the toner is dispersed in the developer and is electrically charged by agitation due to the rotation of the screw auger while the supplied toner is conveyed to the developer carrier. However, when a large amount of toner is consumed and subsequently supplied to the developer container during replenishment, the screw auger may not adequately agitate the developer. Consequently, the toner may not be sufficiently dispersed and charged by friction.

Insufficiently charged toner may adhere to a non-image area, that is, an area in which an electrostatic latent image is not formed on a surface of the latent image carrying member, or scatter to other peripheral devices, thus degrading image quality.

Additionally, when the screw auger or paddle, which has a relatively small surface area, is used, the screw auger may not contact all of the developer, thereby causing insufficient dispersion and charging of the toner.

Accordingly, there is a need for a technology to efficiently agitate the developer to disperse the toner to sufficiently charge the toner triboelectrically without at the same time degrading the developer.

SUMMARY OF THE INVENTION

In view of the foregoing, one illustrative embodiment of the present invention provides a development device that includes a development portion to develop a latent image formed on a latent image carrying member with developer including toner and carrier particles, a circulation unit to convey the developer collected from the development portion to the development portion, the circulation unit including a container to store the developer, disposed upstream from the development portion in a direction in which the developer is circulated, and a first agitator provided inside the container, to agitate and mix the collected developer and fresh toner supplied to the container, the first agitator formed by multiple linear members.

In view of foregoing, one illustrative embodiment of the present invention provides an image forming apparatus that includes a latent image carrying member to carry a latent image, and a development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 12A though 12D show results of an experiment performed to test differences in agitation performance between the agitator shown in FIG. 4 and the agitator shown in FIG. 11B;

DETAILED DESCRIPTION OF PREFERRED EMBODIMENTS

Figure 1:
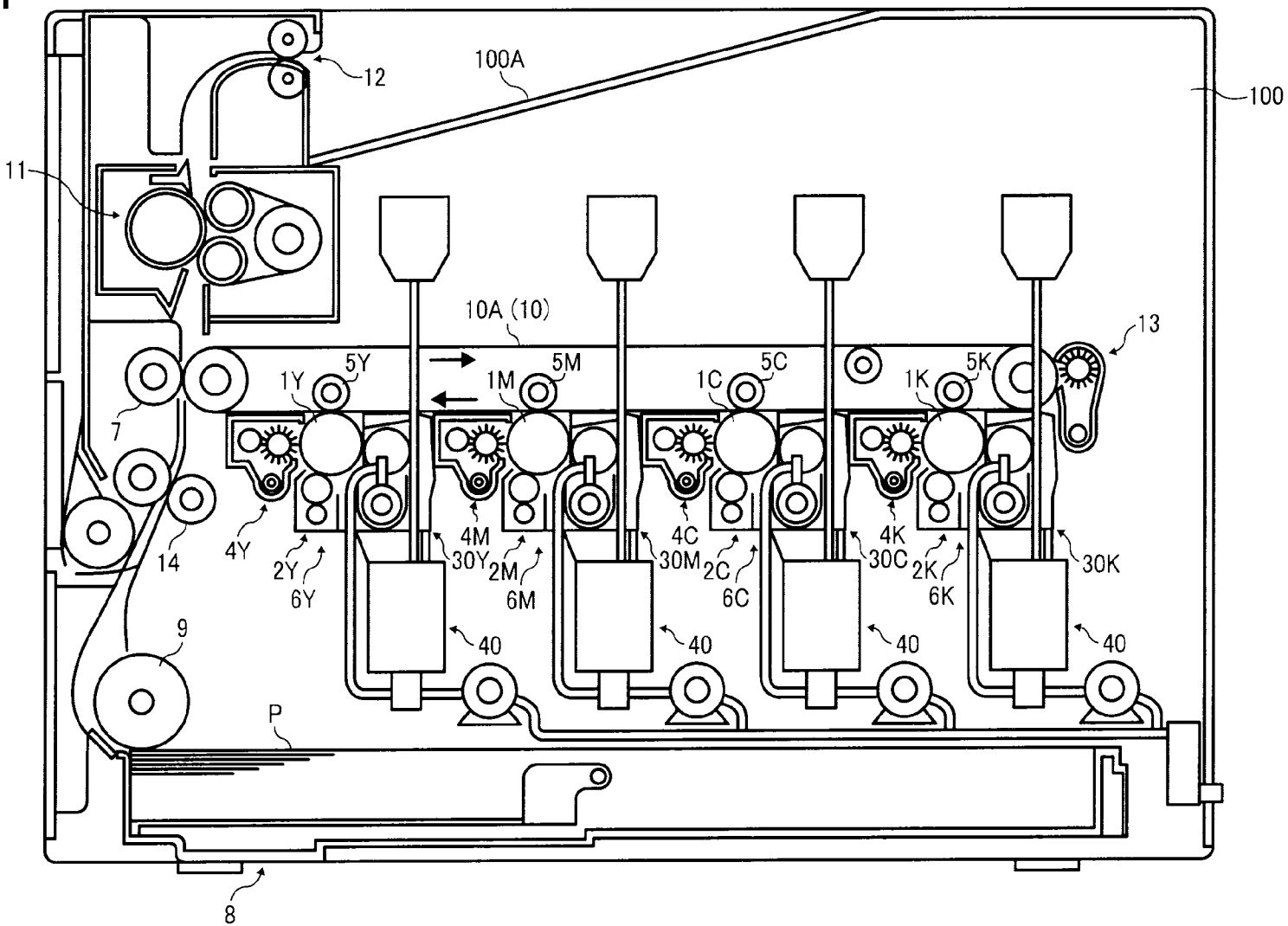
FIG. 1 is a schematic diagram illustrating a configuration of an image forming apparatus including a development device according to an illustrative embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer.

First Embodiment

FIG. 1 is a schematic diagram illustrating a configuration of an image forming apparatus 100 including a development device of the present embodiment.

The image forming apparatus 100 in FIG. 1 includes an intermediate transfer unit 10. Image forming units 6Y, 6M, 6C, and 6K for respectively forming black, magenta, cyan, and yellow (hereinafter also simply "K, M, C, and Y") single-color toner images are disposed facing the lower surface of an intermediate transfer belt 10A in the intermediate transfer unit 10.

It is to be noted that, in this specification, reference character suffixes Y, M, C, and K attached to an identical reference numeral indicate only that components indicated thereby are used for forming different single-color images, respectively, and hereinafter may be omitted when color discrimination is not necessary.

As shown in FIG. 1, a drum-shaped photoreceptor 1 functions as a latent image carrier, and a charging device 2, a development tank 30 of the development device, and a cleaning device 4 are disposed around the photoreceptor 1 in each of the image forming units 6.

On the photoreceptor drum 1, image forming process including a charging process, an exposure process, a development process, a transfer process, and a cleaning process is executed, and thus a desired toner image is formed on the photoreceptor drum 1.

The photoreceptor drum 1 is rotated clockwise by a driving mechanism, not shown, and, in the charging process, the surface of the photoreceptor drum 1 is uniformly charged in a portion facing the charging device 2.

When the surface of the photoreceptor drum 1 reaches a portion receiving a laser beam emitted from an exposure device, not shown, in the exposure process, the laser beam scans the surface of the photoreceptor drum 1, thus forming a latent image on the portion receiving the laser beam.

Then, the portion of the surface of the photoreceptor drum 1 reaches a portion facing the development tank 30, and the latent image thereon is developed into a toner image with the toner included in developer supplied from the development tank 30, that is, development process is executed.

In the primary transfer process, the surface of the photoreceptor drum 1 that carries the toner image developed in the development process reaches the portion facing the intermediate transfer belt 10A and primary transfer bias rollers 5, where the toner image on the photoreceptor drum 1 is transferred onto the intermediate transfer belt 10A.

After the transfer process, the surface of the photoreceptor drum 1 reaches a portion facing the cleaning device 4, where un-transferred toner that remains on the surface of the photoreceptor drum 1 is collected by the cleaning device 4 in the cleaning process.

After the cleaning process electrical potential on the surface of the photoreceptor drum 1 is initialized by a discharging roller, not shown.

Undergoing these processes, the image forming process performed on the photoreceptor drum 1 is completed.

The above-described image forming process is executed in both monochrome printing in black and white and multicolor printing. When multicolor printing is executed, four image forming units 6Y, 6M, 6C, and 6K perform the above-described processes, respectively. Namely, the exposure device (optical writing member), not shown, positioned beneath the image forming units 6 irradiates the respective photoreceptor drums 1 in the image forming units 6 with the respective laser beams in accordance with image data.

After that, the toner images formed on the respective photoreceptor drums 1Y, 1M, 1C, and 1K in the development process are primarily transferred from the photoreceptor drums 1 and superimposed one on another on the surface of the intermediate transfer belt 10A. Thus, a multicolor (four-color) image is formed on the intermediate transfer belt 10A.

The intermediate transfer belt 10A is sandwiched between the primary transfer bias rollers 5Y, 5M, 5C and 5K and the photoreceptor drums 1Y, 1M, 1C and 1K, and primary transfer nips are formed therebetween, respectively. Each primary transfer bias roller 5 applies a transfer bias that has a reverse polarity (e.g., positive polarity) to the polarity of the toner to a backside (inner circumference face) of the intermediate transfer belt 10A.

While the intermediate transfer belt 10A moves in a direction indicated by arrows shown in FIG. 1 and goes through the primary transfer nips sequentially, the respective toner images on the photoreceptor drums 1Y, 1M, 1C, and 1K are primarily transferred and are superimposed one on another on the surface of intermediate transfer belt 10A.

A secondary transfer roller 7, functioning as a secondary transfer member, is disposed facing and pressing against the intermediate transfer belt 10A, forming a secondary transfer nip therebetween. When the four-color toner image formed on the surface of the intermediate transfer belt 10A reaches the secondary transfer nip, the four-color toner image is transferred onto a transfer sheet P, serving as recording media, at one time.

A feeding device 8 is disposed in a lower portion of the image forming apparatus 100 and contains multiple transfer sheets P. The transfer sheet P is fed one-by-one by a feed roller 9.

The transfer sheet P thus fed is stopped by a pair of registration rollers 14, and then skew of the transfer sheet P is corrected, after which the pair of the registration rollers 14 transport the transfer sheet P toward the second transfer nip at an appropriate timing.

The transfer sheet P thus fed is stopped by a pair of registration-rollers 14, and then oblique slip is corrected, after which, the pair of the registration roller 14 transports the transfer sheet P toward the second transfer nip at an appropriate timing. Thus, the desired multicolor toner image is transferred onto the transfer sheet P at the second transfer nip.

The transfer-sheet P onto which multicolor image is transferred at the second transfer nip is transported to a fixing device 11 positioned above the secondary transfer roller 7 in FIG. 1, where the four-color toner image thus transferred is fixed on the surface of the transfer sheet P with heat and pressure in a fixing process.

After the fixing process, the transfer sheets P are discharged toward a discharge sheet tray 100A located on an upper portion of the image forming apparatus 100 via a pair of discharging sheet rollers 12 and are stacked on the discharge sheet tray 100A. Thus, a series of the image forming process completes.

The image forming apparatus 100 further includes a cleaning mechanism 13 that cleans the intermediate transfer belt 10A and developer containers 40 that will be described below.

Figure 2:
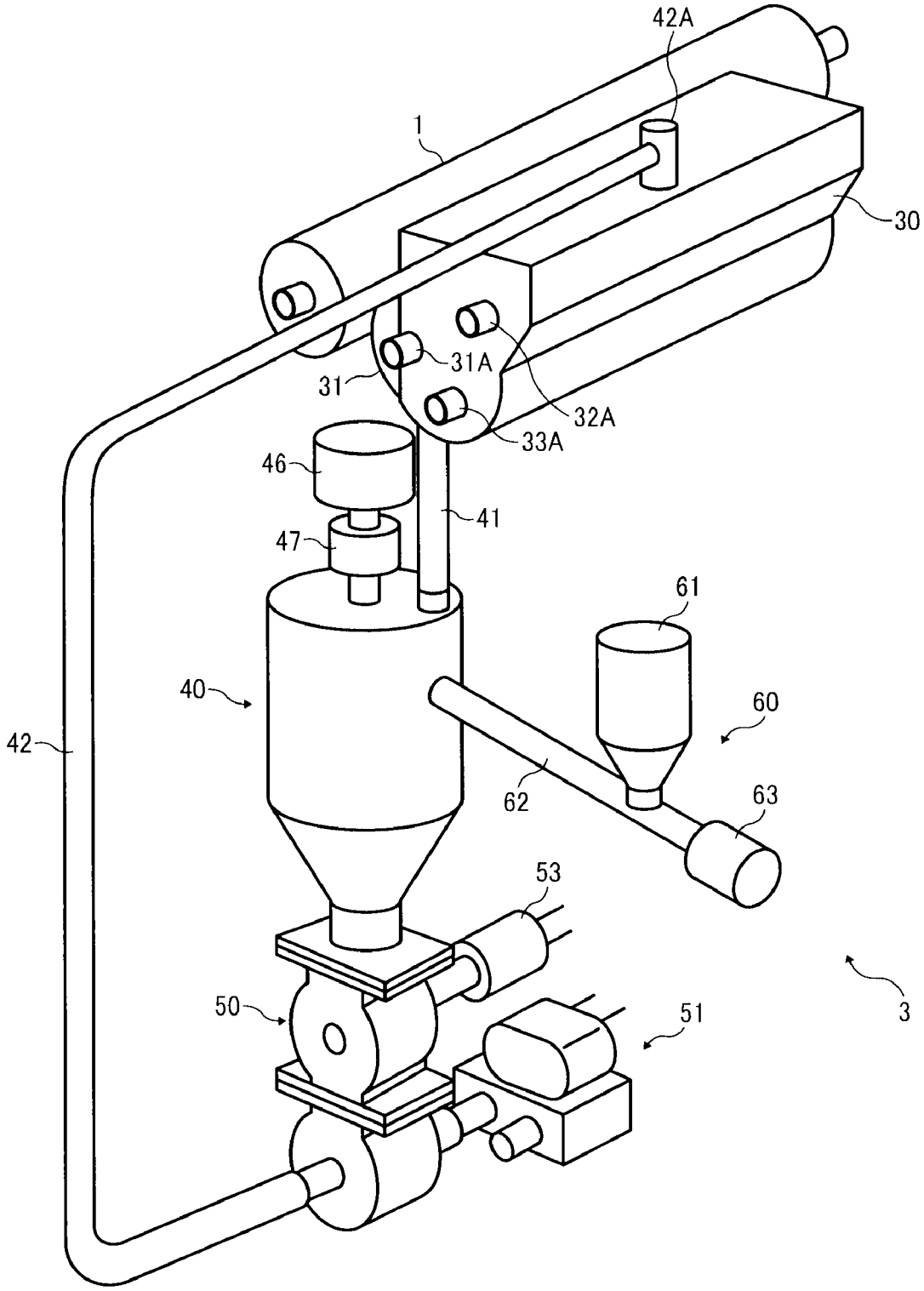
FIG. 2 illustrates an entire configuration of the development device incorporated in the image forming apparatus shown in FIG. 1.

Next, a configuration of the development device is described below. FIG. 2 illustrates an entire configuration of a development device 3 according to the present embodiment. The development device 3 shown in FIG. 2 includes a development portion and a circulation unit, which are described in further detail later. The development portion executes the development process on the photoreceptor drums 1 by using two-component developer in which a carrier and a toner are mixed. The circulation unit conveys the developer collected from the development portion to a supply port 42A in the development portion.

In FIG. 2, the development device 3 includes the development tank 30 serving as a development portion, the developer container 40, a rotary feeder 50, an air pump 51, and a toner supply device 60. The development tank 30 is capable of containing the developer that develops an electrostatic latent image on the photoreceptor drum 1, and in the configuration shown in FIG. 1 the development tank 30 is formed into a cartridge. The developer container 40 that is located separately from the development tank 30 agitates and mixes the developer collected from the development tank 30 with fresh toner whose amount corresponds to the amount of the consumed toner. The rotary feeder 50 transports the developer discharged from the developer container 40 after being agitated therein. The air pump 51 functions as a developer circulation driving source to convey the developer to the development tank 30 with pressurized air. The toner supply device 60 (toner cartridge) supplies the fresh toner to the developer container 40 via a supplying tube 42.

A circulation route is formed with a collecting tube 41 and the supplying tube 42, and both tubes connect the development tank 30 and the development container 40.

In the configuration shown in FIG. 2, the collecting tube 41 directly connects a lower portion of the development tank 30 with an upper portion of the developer container 40. Further, a lower portion of the developer container 40 and an upper portion of the development tank 30 are connected by the supplying tube 42 through the rotary feeder 50 that is located beneath the development tank 30. Thus, a circulation route is formed, and devices provided therealong function as circulation units.

More specifically, the supplying tube 42 is connected to a screw conveyer 32 (shown in FIG. 3) at an axial (longitudinal) center portion thereof. Further, the collecting tube 41 is connected to a downstream side of a shaft of a screw conveyer 33 (shown in FIG. 3) in a direction in which the developer is conveyed (hereinafter "developer transport direction").

The developer container 40 has an upper portion that is cylindrical and a funnel-shaped lower portion. Inside the developer container 40 agitators (to be described in detail below) are provided. A driving motor 46 that drives the agitators and a torque sensor 47 that detects the rotation torque of the agitators are provided above the developer container 40.

Figure 4:
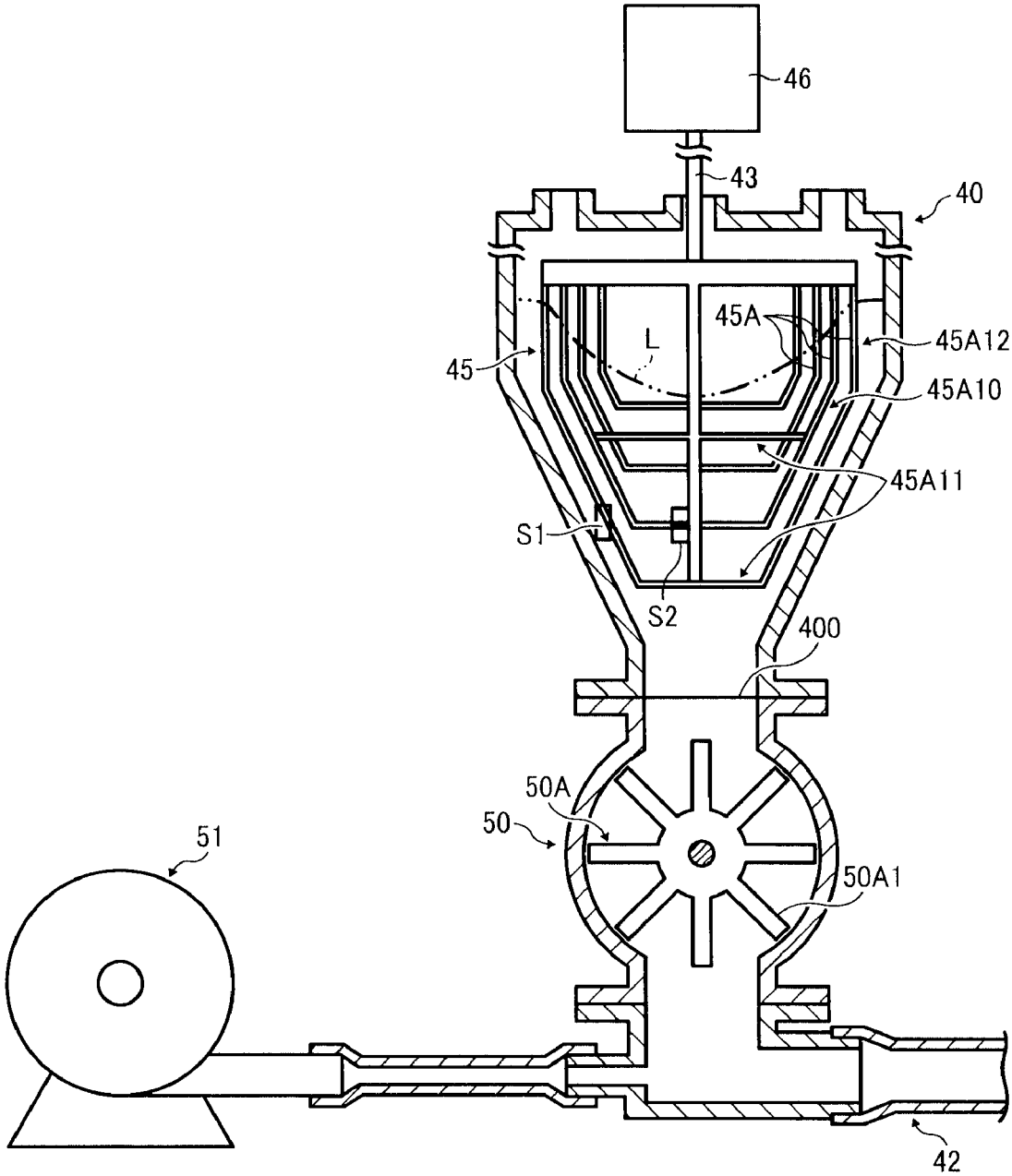
FIG. 4 is a schematic diagram illustrating a main portion of the development device shown in FIG. 2.

The developer agitated in the developer container 40 is supplied to the rotary feeder 50 that can adjust the amount of the supplied developer by rotating an impeller 50A located therein (shown in FIG. 4). The impeller 50A includes blade portions 50A1 driven by a driving motor 53 (shown in FIG. 2). The developer whose amount is thus adjusted is supplied to the development tank 30 by airflow generated by the air pump 51.

The toner supplying device 60 includes a toner tank 61, a toner-supplying tube 62 connecting the toner tank 61 to the developer container 40, and a driving motor 63 that drives the conveying member, not shown, such as screw auger in the toner-supplying tube 62.

The development tank 30 includes a development sleeve 31 and the screw conveyers 32 and 33 (to be described in detail below), end portions of the shafts of which are shown as 31A, 32A, and 33A in FIG. 2.

Figure 3:
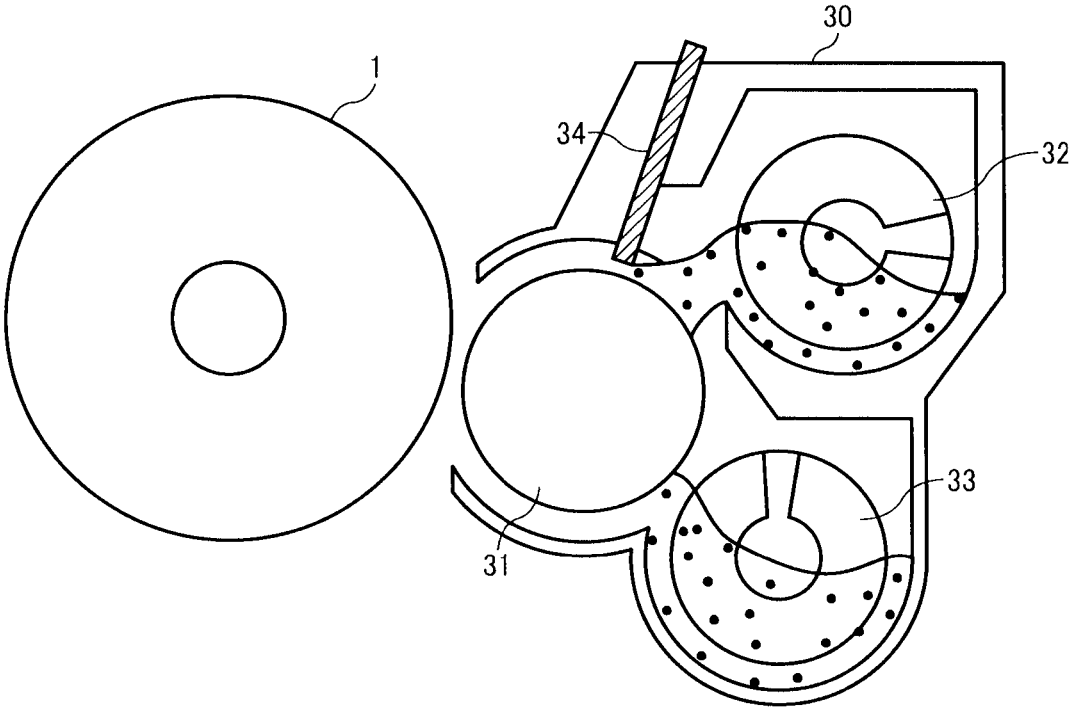
FIG. 3 is a schematic diagram illustrating a configuration of a development portion of the development device shown in FIG. 2.

The interior structure of the development tank 30 is shown in FIG. 3.

As shown in FIG. 3, the development tank 30 includes a doctor blade 34 in addition to the development sleeve 31 and the screw conveyers 32 and 33. The development sleeve 31 carries the developer and is disposed facing the photoreceptor drum 1. The doctor blade 34 adjusts the amount of the developer carried on the development sleeve 31.

The screw conveyers 32 and 33 are offset from the developer sleeve 31 so that they are located respectively higher than and lower than the developer sleeve 31. The screw conveyer 32 moves the developer supplied from the supplying tube 42 through the supply port 42A in the axial center portion of the development tank 30 toward both the front side and the back side of the paper sheet on which FIG. 3 is drawn and the screw conveyer 33 conveys the developer from one end to the another end thereof.

After the screw conveyer 32 moves the developer from the center portion to both end portions of the screw conveyer 32 shown in FIG. 3, developer magnetically attracted by the development sleeve 31 is smoothed by the doctor blade 34 to a uniform thickness. When the surface of the photoreceptor drum 1 contacts the developer where the photoreceptor drum 1 faces the development sleeve 31 (hereinafter "development region"), an electrostatic latent image on the photoreceptor drum 1 is developed with the toner into the toner image thereon.

Developer that passes unused through the development region is discharged and conveyed to the developer container 40 via the collecting tube 41 (shown in FIG. 2) located on an extreme downstream portion of the screw conveyer 33 in the developer transport direction.

A toner concentration detector, not shown, is provided in the extreme downstream portion of the screw conveyer 33 in a direction in which the developer is transported. Fresh toner is supplied from the toner tank 61 in accordance with a signal from the toner concentration detector. As described above, the toner is supplied by a screw conveyer, not shown, disposed in the supplying tube 41.

Next, features of the development device 3 used in the above-described image forming apparatus is described below, in particular a structure to agitate and mix the developer.

FIGS. 4 and 5 show a main portion of the development device 3 in the present embodiment. FIG. 4 illustrates an internal structure of the developer container 40, the rotary feeder 50, and the air pump 51. FIG. 5A is a perspective view illustrating a configuration of an agitator 45 used in the structure shown in FIG. 4.

It is to be noted that, although FIG. 4 shows a configuration in which the supplying tube 62 (shown in FIG. 2) is connected to the top side of the developer container 40, actually, the toner is supplied so that the developer poured above the developer accumulates in the developer container 40. The developer container 40 further includes toner concentration sensors S1 and S2 that are located close to a discharge port 400 (which are described in further detail later with reference to FIG. 12).

As shown in FIG. 4, the developer container 40 is shaped like an upright cylinder, a lower end of which forms a funnel, that is, a tapered portion of downwardly decreasing diameter. The discharge port 400 that is located in the lowest portion of the developer container 40 where the developer container 40 is narrowest and is bottom portion thereof is connected to the rotary feeder 50.

A rotary shaft 43 is inserted vertically into the developer container 40 from a horizontal center portion of the upper surface of the developer container 40 and is connected to the driving motor 46.

An end plate 44 extends from the rotary shaft 43 in a horizontal direction perpendicular to the rotary shaft 43, and the end plate 44 is integrally formed with and on the rotary shaft 43. The agitator 45 is provided on the end plate 44.

As shown in FIGS. 4 and 5, the agitator 45 is formed of multiple linear members 45A that are shaped to the internal contours of the developer container 40 and are geometrically similar but of different sizes.

The multiple linear members 45A are arranged with their horizontal center line aligned with the horizontal center of the developer container 40 in ascending order of width, so that the widest of the linear members 45A connects to the end portion 44 nearest the end of the end portion and the narrowest connects nearest the center.

The linear members 45A thus located are arranged to have gaps (hereinafter "gaps") between adjacent linear members 45A so that at least the carrier particles, whose size is larger than the toner particles included in the developer, can pass through the gaps.

In the present embodiment, the gaps therebetween are set at a pitch that ranges from 0.5 mm to 10 mm.

If the gap is too small, clogging occurs and the mechanical pressure on the developer increases, and if the gap is too large, it is difficult to agitate the toner adequately. Therefore, it is preferable that the gap be set in accordance with the particle diameters of the carrier and the toner in the developer and the fluidity thereof.

For example, when the carrier has a diameter of 35 μm, the toner has a diameter of 5 μm, and the diameter of linear members 45A is within a range from 0.3 mm to 3 mm, it has been experimentally proven that a suitable range of the gaps is from 2 mm to 5 mm.

Using the largest linear member 45A, the configuration of the linear members 45A is described below.

The linear member 45A includes an upper portion 45A12 that extends in a vertical direction (direction of gravitational force), an intermediate portion 45A10 that extends from the upper portion 45A12 along the internal surface of the developer container 40, and a lower portion 45A11 that extends in a direction perpendicular to the gravitational force and is used as a cross-rail to connect together both sides of the intermediate portions 45A10.

The outer diameter of the linear material forming the linear members 45A is such as to be able to move the toner. In the present embodiment, the outer diameter is set within a range from 0.3 mm to 3.0 mm.

Figure 5A:
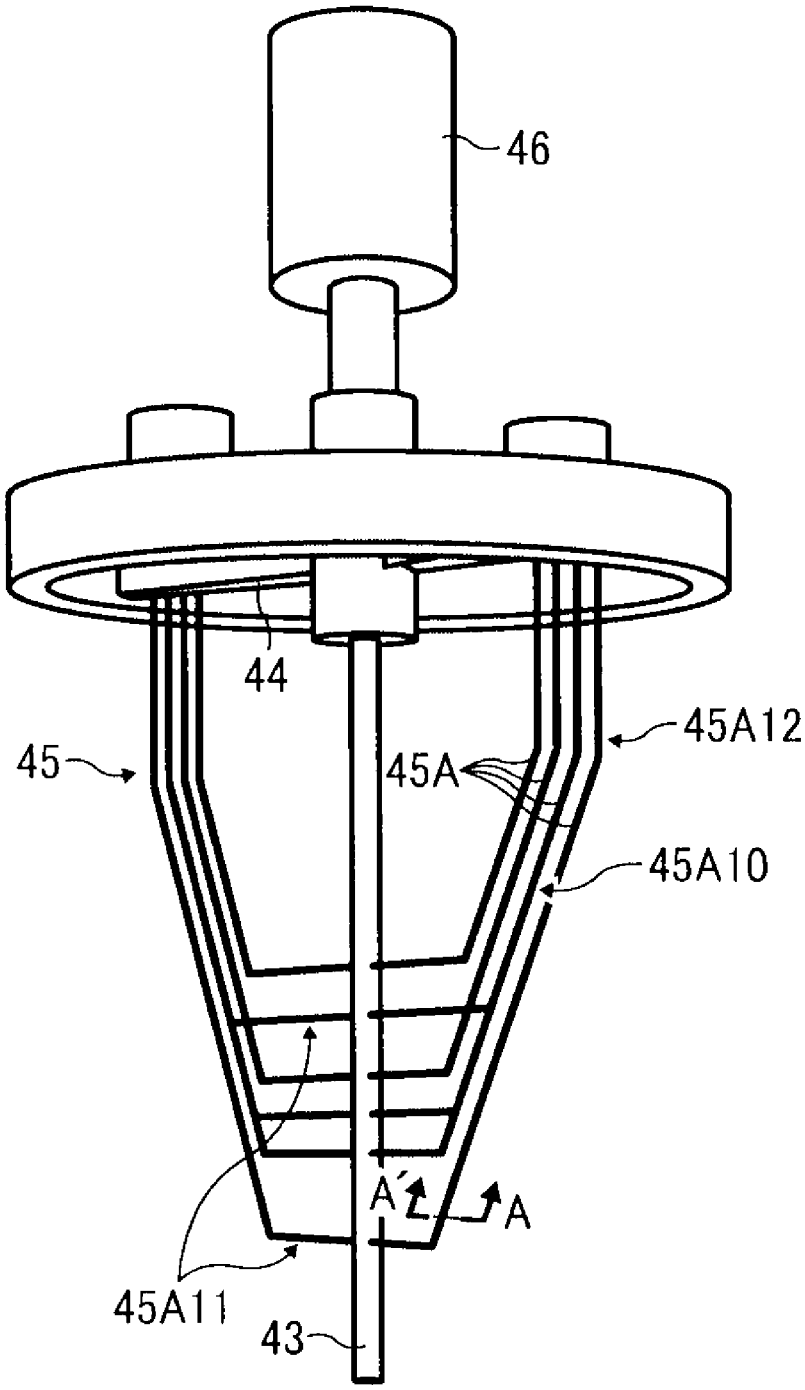
FIG. 5A is a perspective view illustrating a configuration of an agitator formed of linear members used in the main portion of the development device shown in FIG. 4.
Figure 5B:
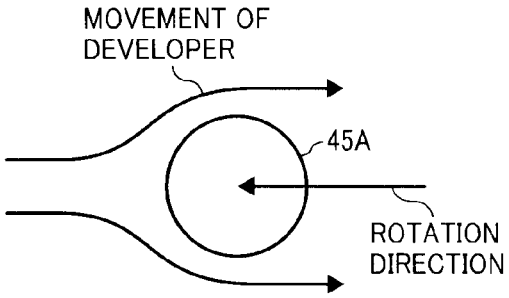
FIGS. 5B through 5D shows a horizontal cross sectional view illustrating examples of the linear member shown in FIG. 5A.
Figure 5C:
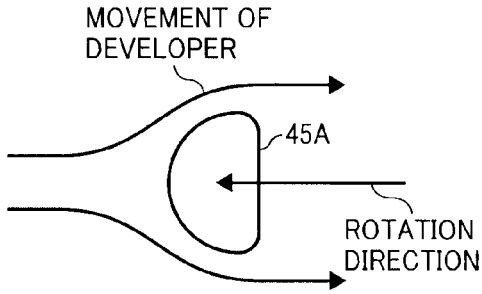
Figure 5D:
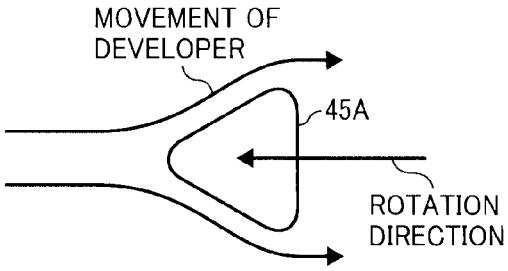

FIGS. 5B through 5D show examples of the shape of the cross section of the linear member 45A. As shown in FIGS. 5B through 5D, the shape of the cross section of the linear member 45A is such that at least a front side in the direction in which the linear member 45A rotates (hereinafter "rotary direction of the linear member 45A") is not sharp-angled, that is, the each of the linear members presents an edgeless face on the front side therein. The front side of the linear member 45A means the portion to which the developer is initially contacted. In the present embodiment, the shape in cross section of the linear member 45A can be rectangular, square, triangular, and diamond shapes with rounded-off corners, in addition to circular and oval, which are typical cross-sectional shapes of wire. With such a shape, fluid resistance when the developer passes through between the linear members 45 can be reduced. Accordingly, a contact load with the developer to the linear members 45A can be reduced, thus facilitating moving the linear members 45A. Additionally the developer can be prevented from physical damage caused by sharp edges.

As a material of the linear member 45A, metal, resin, or the like can be selected, and the linear member 45A can be produced through assembly process by welding or adhering or stamping process from one plate out the device part are used.

Furthermore, the agitator 45 is not configured as a solid resistor to holdback the toner while rotating in the developer, and as a result, the agitator 45 can rotate at high speed and action of the agitation and the mixing can be enhanced.

Improvement in the agitation and mixing that is achieved by the above-described agitator 45 is described below.

The agitator 45 is rotated in a direction in which the developer is restrained from dropping by the rotary shaft 43. Thus, as the linear members 45A rotate while contacting the developer, a centrifugal force acting on the falling developer moves the developer up along the inner surface of the developer container 40.

Figure 6:
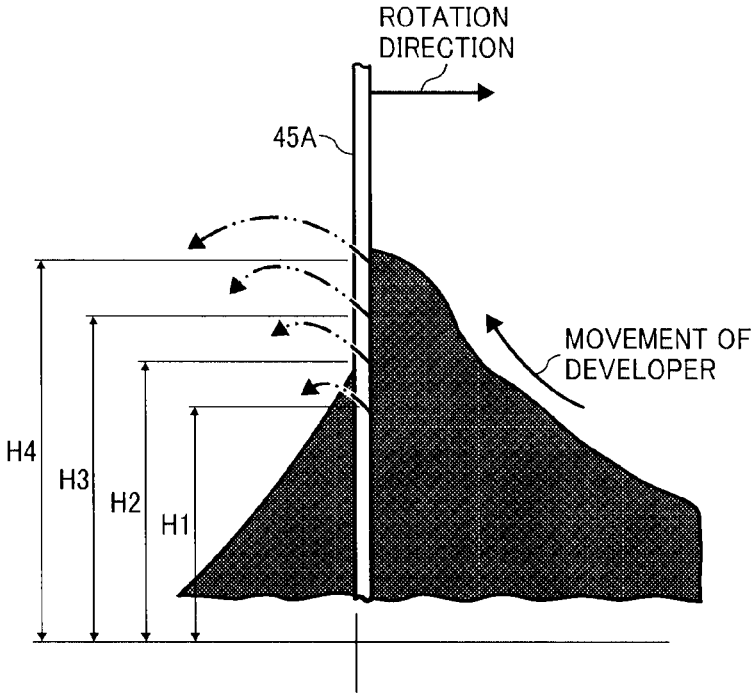
FIG. 6 is a schematic diagram illustrating movement of the developer in the development device shown in FIG. 4 when one of the linear members rotates.

FIG. 6 is a schematic diagram illustrating movement of the developer when one of the linear members 45A rotates. The developer receiving the centrifugal force is gradually piled against the internal surface of the developer container 40, indicated as a dashed line L shown in FIG. 4. Therefore, when the developer thus pressed and piled up gets out from an upstream side in the rotary direction of the linear member 45A to the downstream side thereof, a drop time point, that is, the time point when the developer reaches the surface of the developer layer, differs in accordance with the position where the developer is pressed and piled up against the inner surface of the container.

More specifically, in accordance with the difference in the drop time point, the time when the developer located upstream from the linear member 45A starts accumulating on the surface of the developer accumulated in the developer container 40 while the linear member 45A is moving through the developer differs, in other words, the times when the developer reaches the surface of the accumulated developer, differs. As shown in FIG. 6, the drop time points of the developer are represented by raised positions H1, H2, H3, and H4.

It is preferable that multiple linear members 45A are arranged at a predetermined gap that is determined in accordance with the rotary velocity, so that a certain amount of the developer clogs the gap, which is hereinafter referred to as "clogged state". The clogged state means that the developer cannot pass through the gap between the linear members 45A moving at a given velocity. As a result, a pile of the developer is formed by the linear members 45A and the developer, and the developer that cannot pass through the linear members 45A is moved upward accordingly as the developer moves outward by a centrifugal force. At this time, as the developer is piled up higher, the amount of the developer and density of the developer decrease.

The developer accumulates on the bottom of the developer container 40 in a mass, blocking the flow, and thus, the developer flows more easily through the top of the pile of the developer. As described above, it is preferable that the gap between the multiple linear members is set so that the developer can be pressed and piled up by the centrifugal force and that the linear members are arranged vertically so that a space for the developer to pass through can be kept sequentially in accordance with the density of the developer. Furthermore, because forming the pile of the developer is preferable, it is desirable that the agitator 45 be formed of multiple linear members 45A whose upper portions 45A12 and intermediate portions 45A10 shown in FIG. 5A are arranged at or near the vertical and that the intermediate portions 45A10 of the linear members 45A extend from a portion positioned a predetermined distance from the rotary shaft 43 to a vicinity of the internal surface of the developer container 40. "The vicinity of the internal surface thereof" means that a gap having a sufficient width through which the developer can pass is maintained between the internal surface of the developer container 40 and the external linear member 45A. It is preferable that the width of the gap is set so as not to inhibit the developer from passing through the gap, and thus can vary slightly depending on the particle size of the developer used.

In particular, unlike the configuration in which the agitator is formed of a plate paddle including multiple through holes or formed of a mesh material, because the agitator 45 is formed of multiple linear members 45A as in the present embodiment, only an extremely small area of the agitator 45 is brought into contact with the developer, and therefore clogging can be prevented. Additionally, because the linear members 45A of the agitator 45 can reduce the moving load within the developer, stress on the developer and the driving load can both be reduced, and therefore the agitator 45 can rotate at high velocity. As a result, piling up of developer due to high-velocity rotation is ameliorated, and efficiency of agitating and mixing toner is enhanced in the vertical direction.

In the above-described embodiment, as the agitator 45 rotates, the linear members 45A move through the developer. This movement can speed up, and because the centrifugal force generated by high-velocity rotation is supplied to the developer, the developer is pressed and piled up against the internal sides of the container. Because the piled-up developer reaches the surface of the accumulated developer at different time points (drop time point), the developer poured from above is mixed with the developer accumulated beneath, which can enhance efficiency of agitating and mixing toner in the vertical direction Further, because the developer entraps air while the developer drops down, the fluidization of the developer can be promoted.

Consequently, the developer can be agitated in the vertical direction by varying the drop time points of the piled-up developer in addition to by shearing action of the linear member 45A; and therefore, efficiency of agitating and mixing toner is enhanced in the vertical direction and the toner can be uniformly charged.

Furthermore, because the agitator 45 consists of the linear members 45A, processing can be facilitated and the production cost can decrease. Additionally, the developer can pass between the linear members 45A with less resistance, and therefore, load to the driving mechanism can be improved.

Figure 7A:
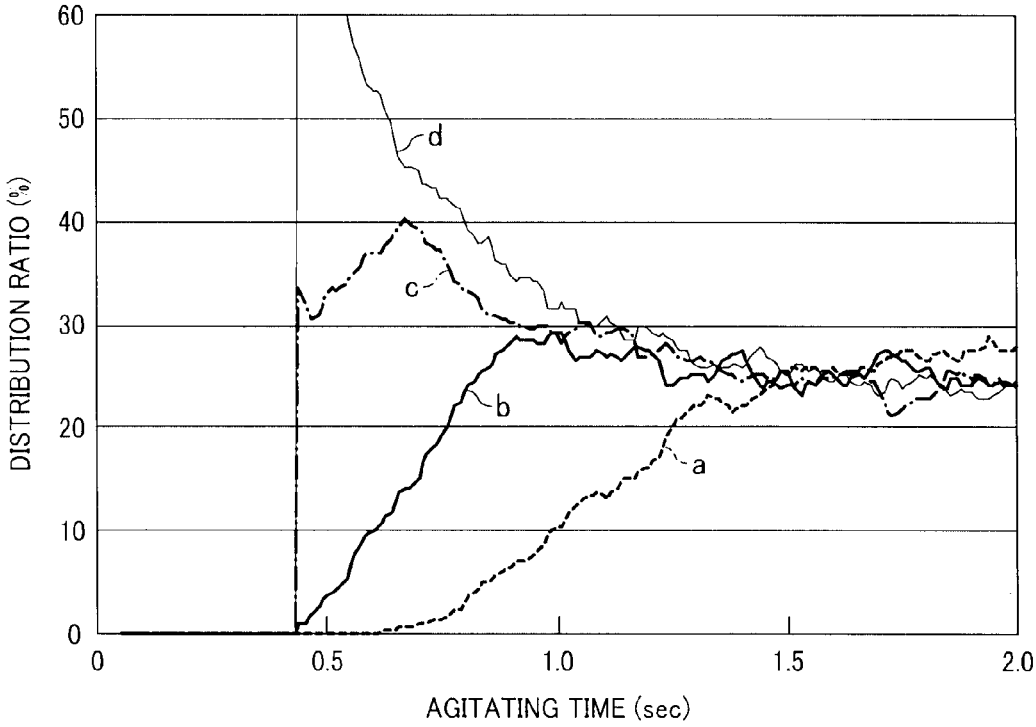
FIGS. 7A and 7B respectively show results of experiments of agitation performance of the agitator shown in FIG. 4 and an agitator shown in FIG. 8.
Figure 7B:
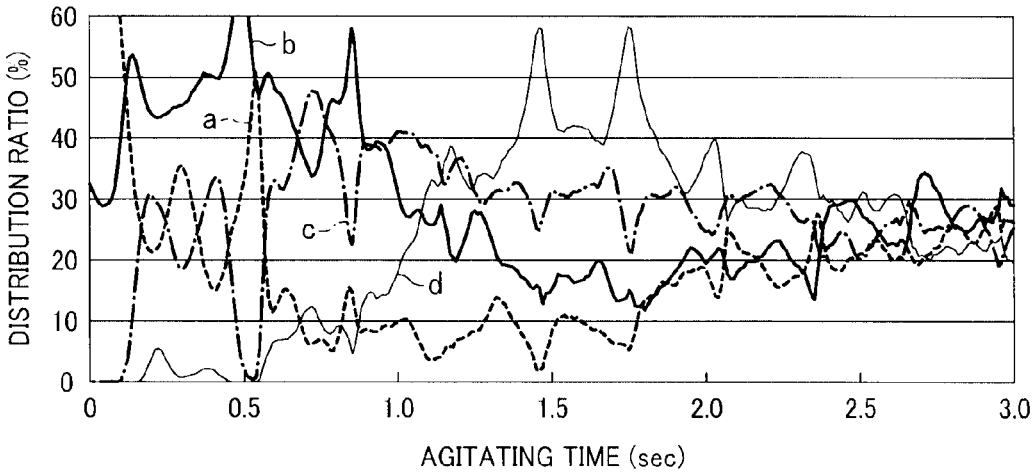

The following describes an experiment that was performed to compare agitation capabilities between the agitator formed of the linear members 45A such as wire (shown in FIG. 4) according to the present embodiment and an agitator formed of non-linear members 45Z such as plate (shown in FIG. 8) according to a comparative example. The results of that experiment result are described below and with reference to FIGS. 7A and 7B. As shown in FIGS. 7A and 7B, the agitator formed of the linear member 45A has better agitation performance than that of the agitator formed of the non-linear member 45Z.

Figure 8:
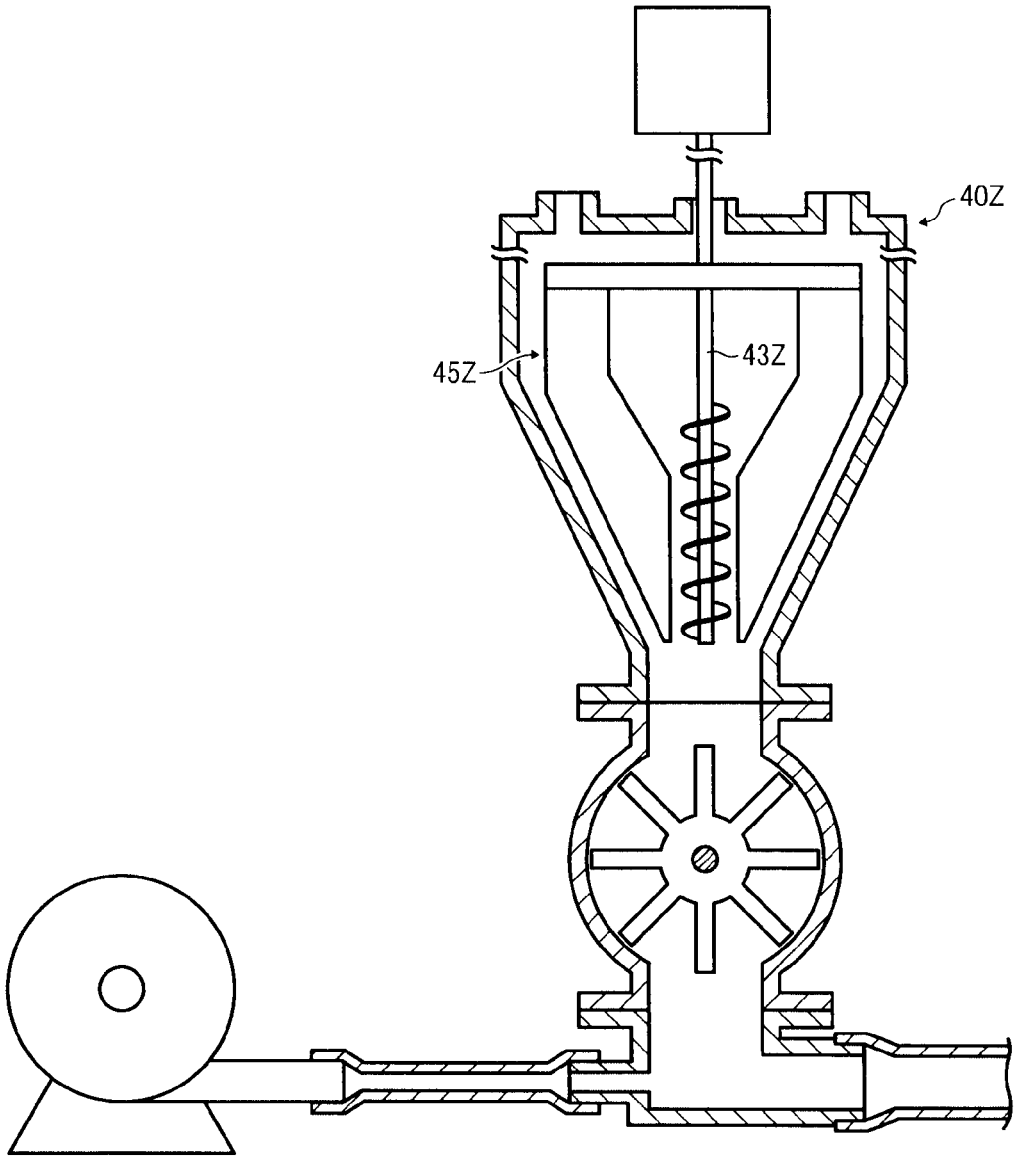
FIG. 8 is a schematic diagram illustrating an agitator formed of non-linear members as a comparative example used to obtain the results of experiments shown in FIG. 7B.

The experiment was performed using the agitator 45 formed of the linear members 45A according to the present embodiment shown in FIG. 4 and the agitator formed of non-linear members 45Z, such as a plate or paddle, according to the comparative example shown in FIG. 8. FIG. 7A shows an experiment result when the agitator 45 was used, and FIG. 7B shows an experiment result when the comparative configuration was used.

In the experiment, initially, the developer particles in the developer container 40 or 40Z are separated into four horizontal layers a through d ("a" indicates the highest layer, and "d" indicates the lowest layer), and the thus layered particles are agitated by the linear members 45A or the non-linear members 45Z. Then, the relations between the ratios of the particles from the layers a through d present in the vicinity of the internal surface of the developer container 40 or 40Z and the agitating time were plotted.

As a result, it was found that, when the non-linear member 45Z was used as the agitator 45, it took 2.5 seconds to 3 seconds (shown in FIG. 7B) from the start of agitation to equalize the distribution of the particles from the layers a though d in the vicinity of the internal surface of the developer container 40Z.

By contrast, when the linear member 45A was used as the agitator 45, it took only 1.4 seconds to 1.5 seconds (shown in FIG. 7A) to equalize the distribution of the particles from the layers a though d in the vicinity of the internal surface of the developer container 40

Consequently, it was confirmed that the agitator 45 formed of the linear members 45A can substantially improve agitation performance as compared with the agitator 45 formed of the linear members 45Z.

Figure 9:
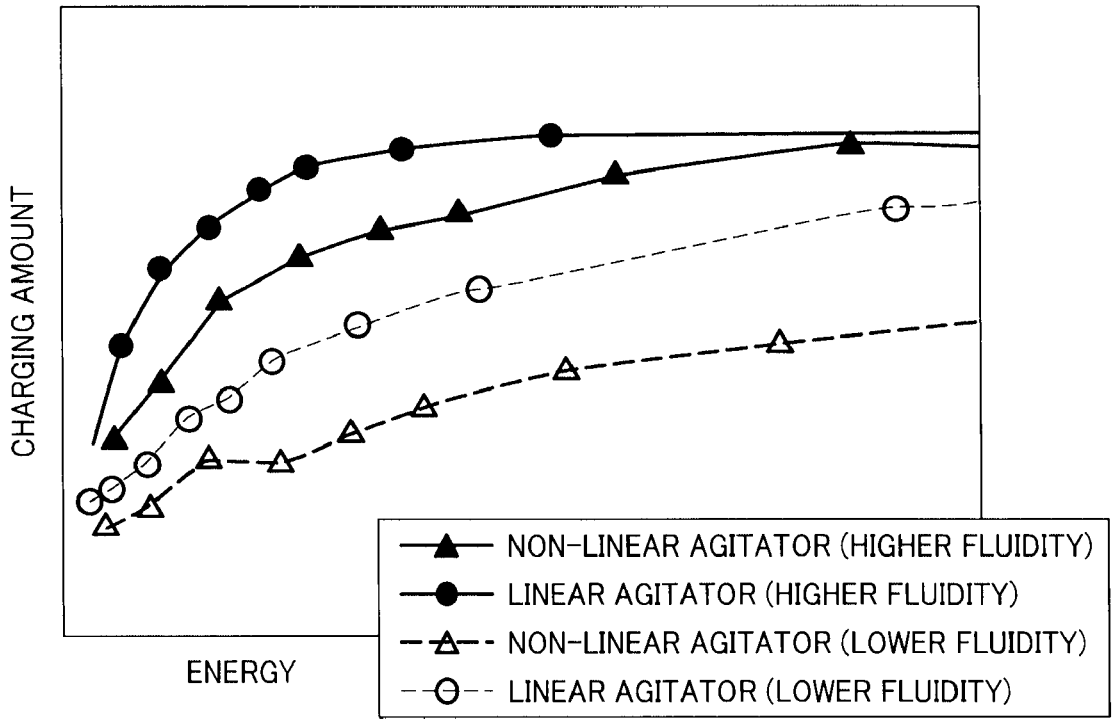
FIG. 9 is a graph illustrating results of experiments regarding charging amount of the developer agitated by the agitators shown in FIGS. 4 and 8.

Next, a result of an experiment performed to measure a charging property of the developer agitated by the agitator formed of the linear members 45A and that agitated by the agitator formed of non-linear members 45Z is shown in FIG. 9.

FIG. 9 shows the results of the experiment obtained when a predetermined toner concentration (7 wt % (weight percent)) of the developer was agitated by the linear member 45A (shown as linear agitator in FIG. 9) or the non-linear member 45Z (shown as non-linear agitator in FIG. 9). The charge on the developer in the vicinity of the internal surface of the developer container 40 or 40Z was then measured while the developer was not being circulated. In FIG. 9, the vertical axis indicates charging amount and the horizontal axis indicates an energy that is determined by multiplying power consumption of the driving motor 46 during agitating the developer by drive time. In the experiment whose results is shown in FIG. 9, both the developer that has a higher degree of fluidity and the developer that has a lower degree of fluidity were used.

As is clear from the results of the experiment shown in FIG. 9, whichever developer is used, the agitator formed of the linear members 45A in the present embodiment can charge the developer more quickly than the non-linear agitator can, and can agitate and mix the toner and carrier immediately, and therefore, due to the shear effect, it is confirmed that the developer is charged appropriately by friction.

From the results of this experiment, it can be seen that the energy of agitation is adequately converted into the charging amount of the developer. Moreover, because the developer is not subjected to excessive stress, the efficiency with which the toner can be agitated and mixed into the developer can be enhanced.

Second Embodiment

Next, another embodiment of the present invention is described below.

Figure 10A:
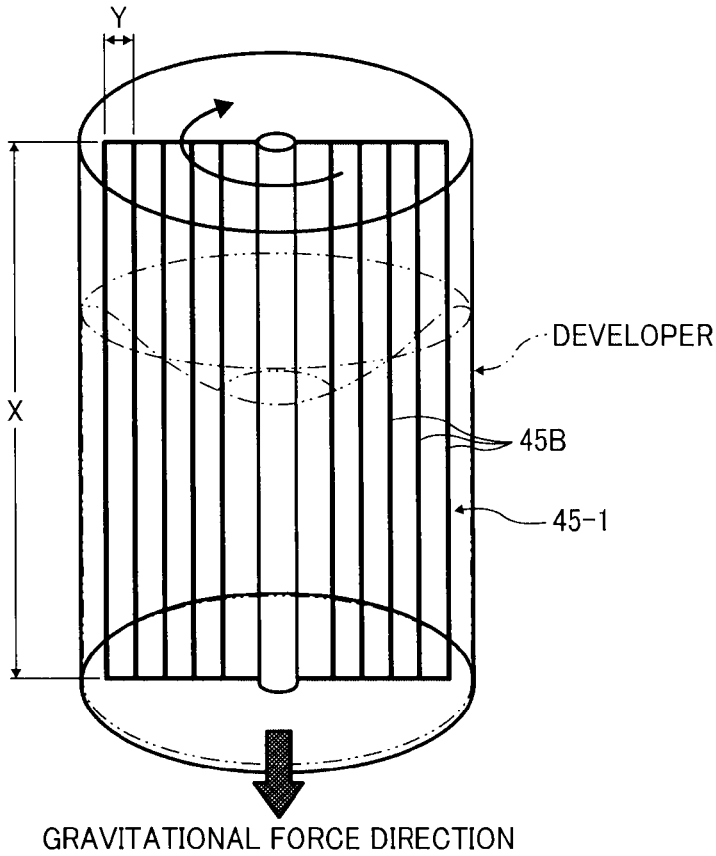
FIGS. 10A though 10F illustrate structures of agitators using multiple linear members according to another embodiment.
Figure 10B:
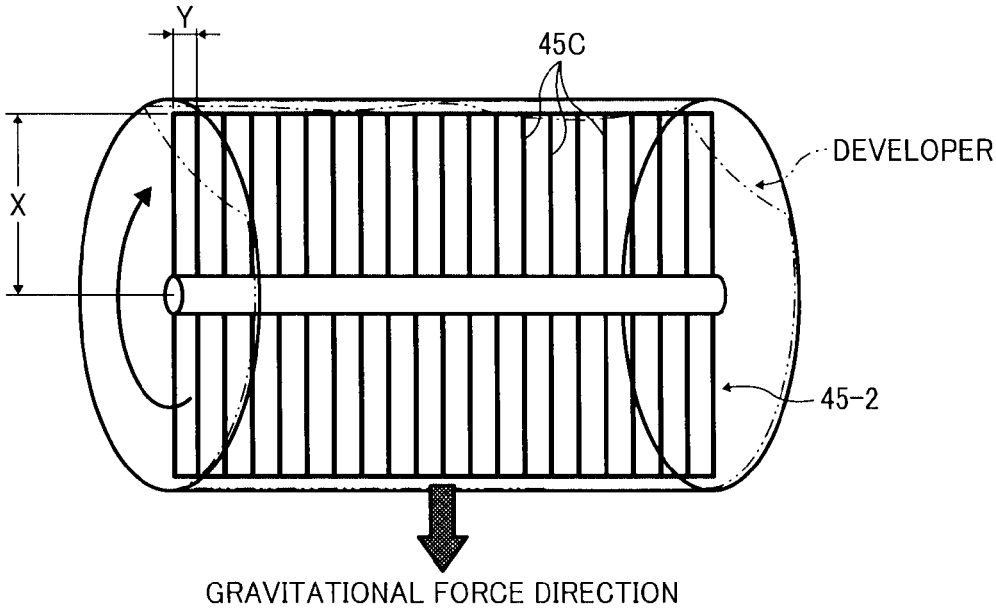
Figure 10C:
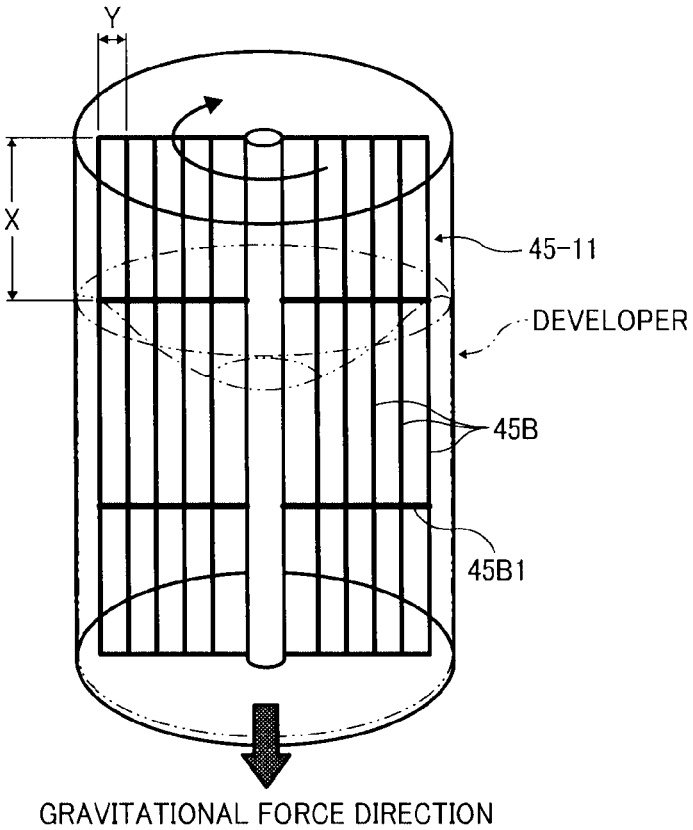

FIGS. 10A and 10B illustrate structures of agitators 45-1 and 45-2 respectively using multiple linear members 45B and 45C according to the second embodiment. In FIG. 10A, the linear members 45B extend in a direction parallel to the vertical, and a rotary shaft of the linear member 45B extends in the direction parallel to the gravitational force. In FIG. 10B, the linear members 45C extend in the direction parallel to the vertical, and a rotary shaft of the linear member 45C extends in a direction perpendicular to the vertical.

In the arrangement shown in FIG. 10B, when the linear members 45B rotate, the developer is effectively pressed and piled up against the inner surface of the container as described above with reference to FIG. 6. Consequently, time lags in the drop time point are generated by piling up the developer, and then, the developer can be charged by the shearing action of the agitator 45-1 that rotates. Additionally, the developer can be charged frictionally by agitating and mixing the developer in the vertical.

Although in the embodiment described above the linear members 45B and 45C are shown extending in the vertical direction, the linear members 45B and 45C can be inclined from the vertical several degrees (e.g., 45 degrees). However, it has been experimentally proven that, as the angle between the linear members 45B or 45C and the vertical approaches 0 degree, the developer is more evenly piled up along the vertical. Therefore, it is preferable that the linear members 45B and 45C are set at an angle to the vertical that is as close to 0 degrees as possible.

In the configurations shown in FIGS. 10A and 10B, the agitator may further include linear members extending horizontally as variations, which are described below with reference FIGS. 100 and 10D.

Figure 10D:
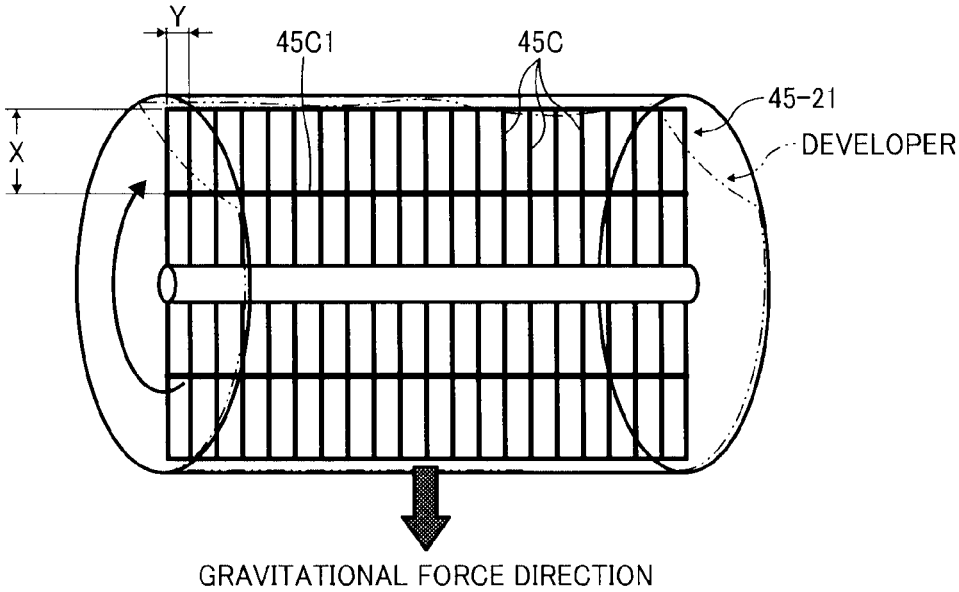

As shown in FIGS. 100 and 10D, agitators 45-11 and 45-21 respectively include horizontal portions (linear members) 45B1 and 45C1 that extend in a direction perpendicular to the vertical in addition to the structure shown in FIGS. 10A and 10B. In the configuration, the movement of the developer that drops at different time points may be disturbed by the horizontal portions 45B1 or 45C1 extending perpendicularly to the vertical.

To solve this problem, as shown in FIGS. 100 and 10D, the gap between adjacent horizontal portions 45B1 or 45C1 in the vertical direction is set relatively wide. More specifically, when X indicates an gap between the horizontal portions 45B1 or 45C1 in the vertical direction and Y indicates an gap between the linear members 45B and 45C perpendicular to the vertical direction, it is preferable that the relation between X and Y satisfy $X \geqq 2Y$.

In the configurations shown in FIGS. 10A through 10D, the centrifugal force increases the farther away from the rotation shaft (hereinafter "outer portion", and the efficacy of the agitating developer is enhanced in the outer portion. Therefore, as a further refinement, the gap between the horizontal portions in the vertical direction may be greater in the outer portion than in a portion closer to the rotation shaft, which is described below with reference to FIGS. 10E and 10F.

Figure 10E:
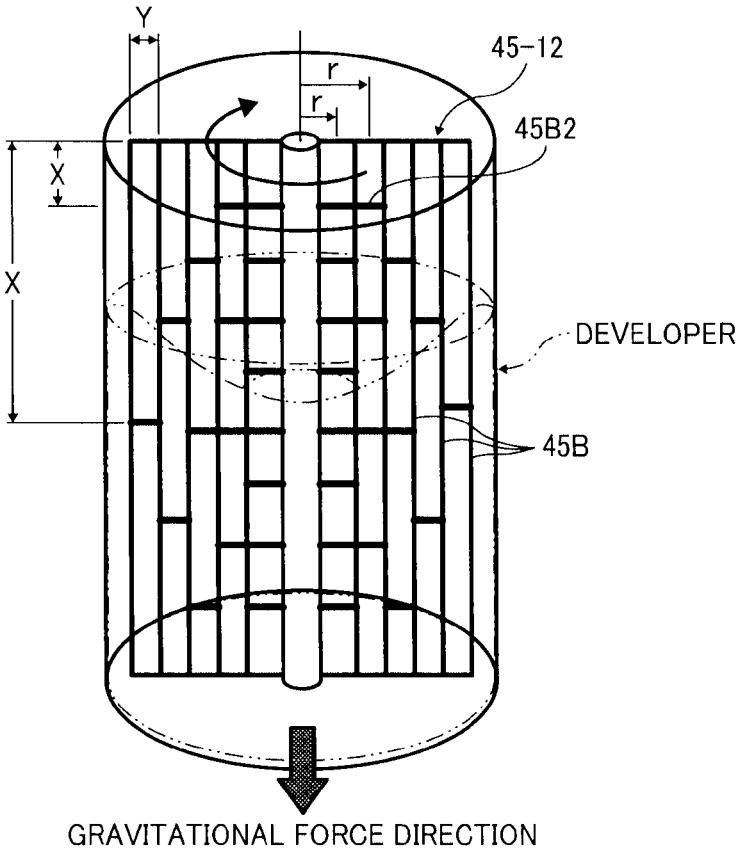
Figure 10F:
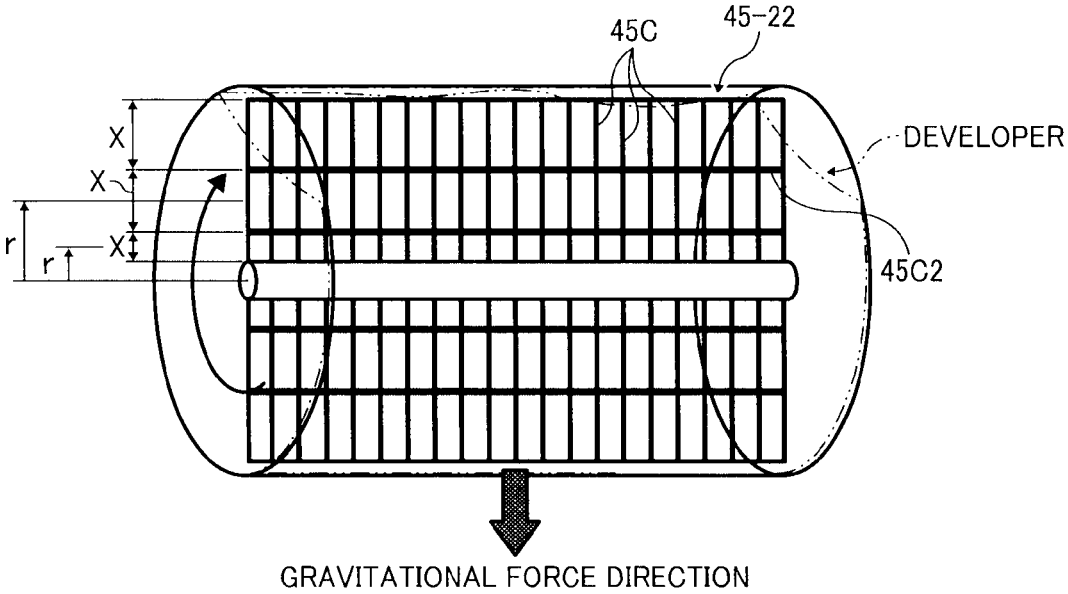

In the configurations shown in FIGS. 10E and 10F, in the center portion, horizontal portions 45B2 or 45C2 in the vertical direction are arranged more densely and the gaps X between them are smaller, that is, the number of horizontal portions extending in a direction perpendicular to the vertical direction is greater in the center portion. By contrast, the gap X in the outer portion is relatively wide.

More specifically, when "r" indicates a distance from the rotation axis to the center of the gap between given two adjacent linear members, the relation between X and r can be expressed as;

$$X=ar$$

for example, the coefficient "a" can be determined according to fluidity of the developer to correct reduction of the agitation member.

Regarding the gap Y between the vertical portions of the linear members 45B and 45C arranged in the horizontal direction, similar to the gap X, the number of the vertical portions extending in the vertical direction may be greater in the center portion to increase the density of the vertical portions in the center portion.

Third Embodiment

Next, agitators according to another embodiment are described below with reference to FIGS. 11A, 11B, and 11C that illustrate internal structures of developer containers 40D and 40E.

In the third embodiment, an inner agitator 70 extends coaxially along a rotary shaft 43D (vertical center axis) that extends vertically from a horizontal center portion of the upper surface of the developer container 40D, and an outer agitator 450 is located outside of the inner agitator 70. The outer agitator 450 serves as a first agitator, and the inner agitator 70 serves as a second agitator.

Figure 11A:
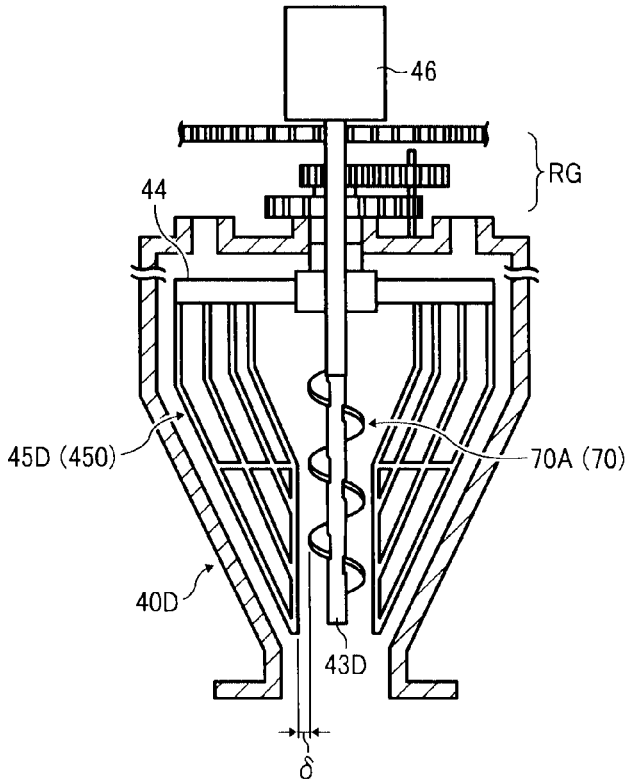
FIGS. 11A and 11B respectively show an internal structure of a developer container including an inner agitator and an outer agitator according to another embodiment.

FIG. 11A is a vertical cross-sectional diagram viewed from a front side of the developer container 40D, illustrating the internal structure of the developer container 40D. FIG. 11B is a horizontal cross-sectional diagram viewed from overhead, illustrating the structure of the developer container 40D that includes linear members 45D shown in FIG. 11A. FIG. 11C is a horizontal cross-sectional diagram viewed from overhead, illustrating the structure of the developer container 40E that further includes linear members 45E and which therefore differs from the linear member 45D.

In FIG. 11A, the outer agitator 450 is formed of multiple linear members 45D, the inner agitator 70 is formed of a screw 70A, and the rotary shaft 43D functions as the rotation axis for both the outer agitator 450 and the inner agitator 70.

Figure 11B:
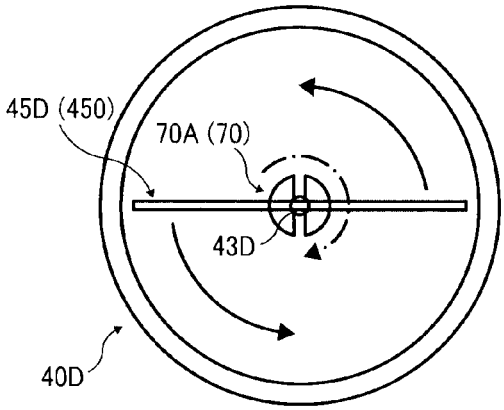

As shown in FIG. 11B, the linear members 45D used for the outer agitator 450 are attached to an end plate 44D (shown in FIG. 11A) that extends in the horizontal direction and aligned vertically with the end plate 44. The linear members 45D are not present in a rotary center portion. That is, the linear members 45D are attached to the end plate 44D, similar to the linear member 45A shown in FIGS. 4 and 5.

It is to be noted that a propeller or a paddle can be used for the inner agitator 70, instead of the screw 70A.

Figure 11C:
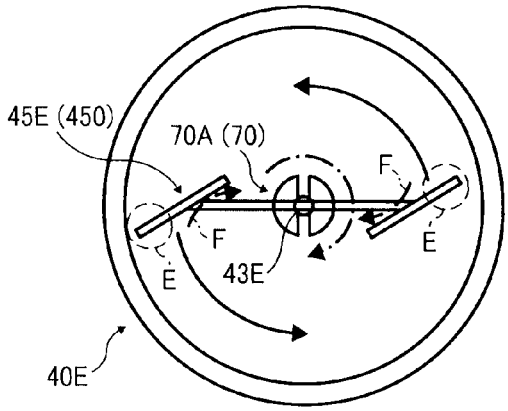
FIG. 11C is a horizontal cross-sectional diagram viewed from overhead, illustrating a variation of the configuration shown in FIGS. 11A and 11B.

By contrast, in the configuration shown in FIG. 11C, differently from the structure shown in FIGS. 11A and 11B, the linear members 45E are not aligned vertically with the end plate 44 but angled with respect to the end plate 44. That is, the linear members 45E are arranged at an angle to the end plate 44 so that the developer can move toward the rotary shaft 43E. More specifically, the outer agitator 450 formed of the linear member 45E is inclined so that its outer end portion indicated with a circle E shown in FIG. 11C, away from the rotary shaft is upstream from its inner end portion close to the rotary shaft in a direction in which the linear member 45E rotates.

As described above, the inner agitator 70 shown in FIG. 11C may be formed of a screw 70A or a paddle, similarly to the configuration shown in FIG. 11A.

The configurations shown in FIGS. 11B and 11C employ same driving mechanisms. That is, in FIGS. 11A to 11C, the linear members 45D and 45E used for the outer agitator 450 are rotated by a driving motor 46D. The screw 70A is connected directly to the driving motor 46D and rotates in the direction that lifts the developer upward. By contrast, the linear members 45D and 45E are connected via gear group to a gear group RG to the driving motor 46D and thus decelerated by the gear group RG. That is, the rotation velocity of the inner agitator 70 and the outer agitator 450 can be made to differ.

It is to be noted that, in order to vary the rotary velocity, as described above, the gear functioning as a velocity control mechanism can be connected to an identical driving source to drive both the inner agitator 70 and the outer agitator 450, or alternatively, the inner agitator 70 and the outer agitator 450 may be rotated by separate driving sources.

The configuration in which the rotary velocities of the outer agitator 450 and the inner agitator 70 can be set separately is advantageous because, for example, when the rotary velocity of the outer agitator 450 is required to be increased, the stress of the developer can be alleviated by maintaining the velocity of the screw 70A as is.

In the above-described configuration shown in FIG. 11B, due to rotation of the linear member 45D, the developer is pressed and piled up against the inner surface of the container similar to FIG. 6. In the present configuration, while the piled developer flies, forming a parabola, and then reaches the surface of the accumulated developer in the developer container 40D at different drop time points, the developer is raised by the screw 70A. Therefore, convection is generated by dropping the developer in the vicinity of the inner surface of the developer container 40D and raising the developer in the center portion in the developer container 40D. As a result, the developer is agitated and mixed evenly throughout the entire developer container 40D.

By contrast, in the configuration shown in FIG. 11C, due to rotation of the outer agitator 45E (450), the developer is pressed and piled up similar to the configuration shown in FIG. 11B. However, a certain amount of the piled-up developer is dropped toward the rotary center portion by the inclined linear members 45E. In the configuration shown in FIG. 11C, as the outer agitator 45E (450) rotates, a certain amount of the developer piled up against the inner surface of the container is almost forcibly dropped toward the rotary center portion, and therefore, the amount of developer poured on the screw 70A in the rotary center portion can be greater than that of the configuration shown in FIG. 10B. Consequently, the developer can be more surely convected in the developer container 40E.

It is to be noted that, if only the linear member 45D or 45E used as the outer agitator 450 rotates, the amount of the centrifugal force differs depending on the radius from the rotation center. Therefore, the agitation and mixing capability in the rotary center portion tends to be lower than that in the outer circumferential portion due to the smaller centrifugal force acting thereat. However, in the configuration shown in FIGS. 11B and 11C, using the screw 70A (inner agitator) in the rotary center portion, the developer can be agitated in a direction to inhibit the developer from dropping along the gravitational direction. Therefore, the decrease in the efficacy of the agitation in the rotary center portion can be prevented. Additionally, the convection of the developer can be caused, and the ratio of the agitation and mixing can be promoted compared to the configuration employing only the linear member 45D or 45E.

In particular, when the linear member 45E is used, because the linear member 45E is inclined to move the developer to the rotary center portion, the developer is more effectively moved toward the screw 70A to impede the reduction in the agitation efficacy of the developer. Thereby, as described above, the developer can be more surely convected.

It is to be noted that, in the configurations shown in FIG. 11A through 11C, the outer agitator 450 and the inner agitator 70 are located across a gap δ (shown in FIG. 11A) from each other. It is desirable that the distance of the gap δ between the inner surface of the outer agitator 450 and the outer surface of the inner agitator 70 be set so that the convection is not interrupted, that is, the gap δ does not impede the developer from being raised by the inner agitator 70.

Herein, the following describes an experiment that was performed to compare the agitation performance between the configuration using only the agitator formed of the linear members (shown in FIG. 4) and the configuration using both the first and second agitators (shown in FIG. 11A through 11C).

FIGS. 12A and 12B show results of an experiment in which only the first agitator formed of the linear members was used. FIGS. 12C and 12D show results of an experiment in which the first and second agitator was used.

The experiment was performed using the developer concentration sensors S1 and S2 shown in FIG. 4. The developer concentration sensors S1 and S2 were located close to the discharge port 400 and respectively used to detect the concentration of the toner in a center portion and that in an outer portion (shown as "end portion" in FIGS. 12A through 12D).

In the experiment, initially, using the position where the toner concentration sensor S1 and S2 were disposed as a border, and setting a target toner concentration to 7 wt % (weight percent), developer in which a toner percentage was 10 wt % was supplied in an upper portion of the developer container 40 or 40D and the developer in which a toner percentage was 4 wt % was supplied in a lower portion of the developer container 40 or 40D. Then, the outer agitator 450 and inner agitator 70 agitated the developer in which these two different toner concentrations were layered. The results of this experiment are shown in FIGS. 12A though 12D.

In FIGS. 12A through 12D, TC indicates a toner concentration, Q/M indicates charge per unit weight of accumulated developer, and DA indicates a conversion value of charging amount when the toner concentration was 7 wt %.

FIGS. 12A and 12B show results of an experiment result in which the linear member 45A used for the agitator 45 was rotated at a velocity of 450 rpm. FIGS. 12C and 12D shows results of an experiment in which the outer agitator 450 formed of the linear members 45D (spaced 3 mm apart) was rotated at a velocity of 450 rpm while the screw 70A used as the inner agitator 70 was rotated at a velocity of 400 rpm.

According to the results shown in FIGS. 12A through 12D, regarding the toner concentration (TC) it can be seen that the configuration using both the outer agitator 450 and the inner agitator 70 can more reliably maintain a target concentration.

Fourth Embodiment

Next, another embodiment is described that employs two agitators each of which is formed of linear members, and rotary shafts of both agitators both offset from a horizontal center portion of the developer container.

Figure 13A:
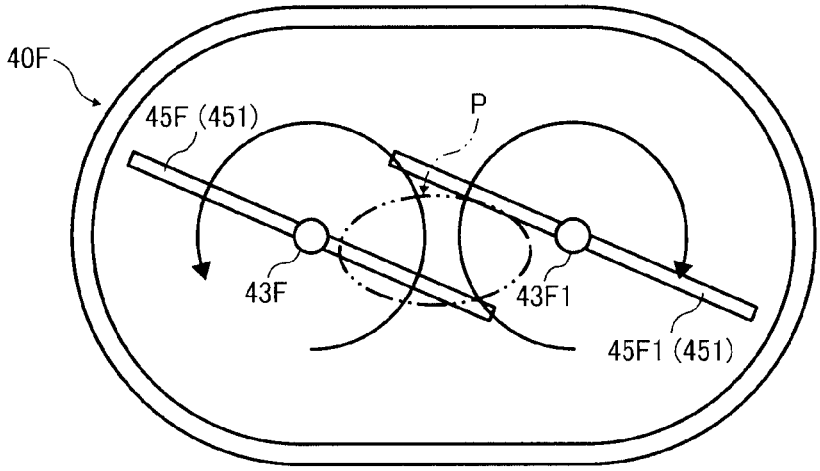
FIGS. 13A and 13B show a structure of a developer container that includes multiple agitators respectively formed by linear members according to another embodiment.
Figure 13B:
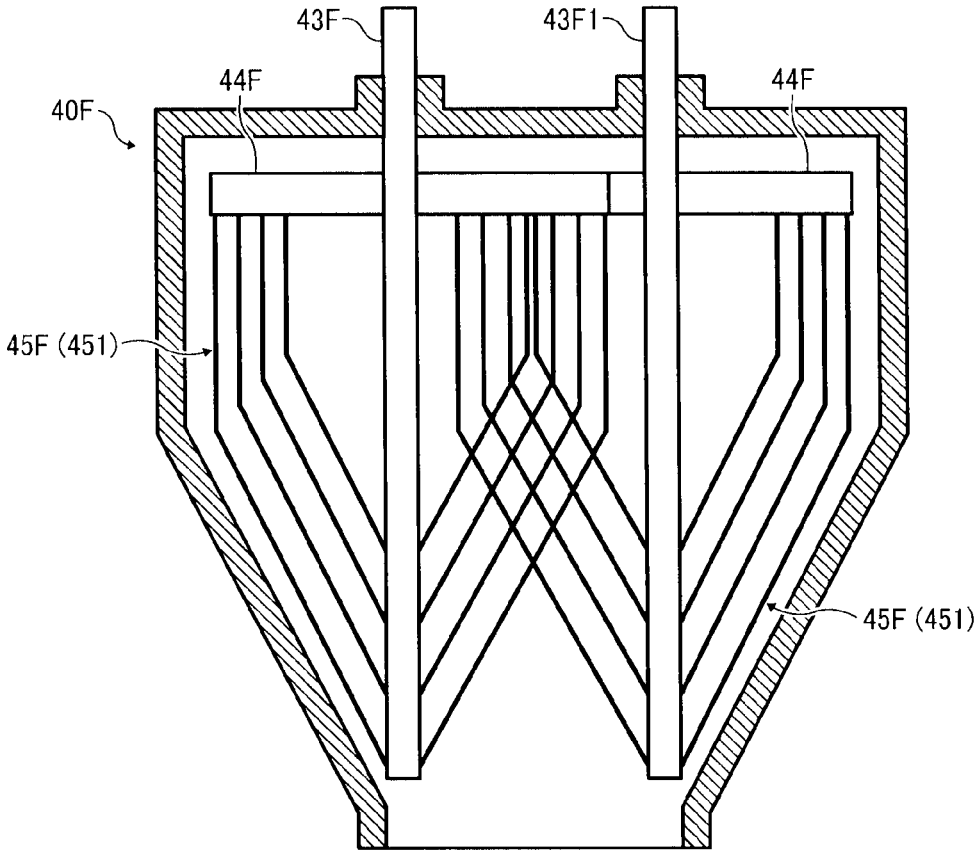

FIG. 13A is a horizontal cross-sectional diagram of a developer container 40F viewed from overhead, illustrating the structure of the developer container 40F that includes agitators 451 respectively formed by linear members 45F and 45F1. FIG. 13B is a cross-sectional diagram of the developer container 40F shown in FIG. 13A viewed from a front side.

In the configuration shown in FIGS. 13A and 13B, rotary shafts 43F and 43F1 of two agitators 451, respectively formed of multiple linear members 45F and 45F1, are offset from the center portion in the developer container 40F as shown FIG. 13A. In particular, the linear members 45F and 45F1 are located so that rotational trajectories of the linear members 45F and 45F1 overlap each other in a center portion (circular portion F indicated by a dashed line in FIG. 13A) in the horizontal cross section of the developer container 40F. The linear members 45F and 45F1 used for the agitators 451 rotate in opposite directions. The agitators 451 serve as a first agitator and an additional agitator identical to the first agitator.

It is to be noted that, although in the above-described embodiment the cross section of the developer container 40F shown in FIG. 13A is oval because the linear members 45F and 45F1 are offset from the horizontal center portion of the developer container 40F, alternatively the cross section of the developer container 40F may be square or rectangular.

In this configuration, in the horizontal center portion of the developer container 40F, the centrifugal force is lessened. However, because the rotational trajectories of the linear members 45F and 45F1 overlap each other in the horizontal center portion, the efficiency of agitating and mixing toner is enhanced where the centrifugal force is reduced, and the agitation performance and charging performance can be enhanced.

Fifth Embodiment

Figure 14A:
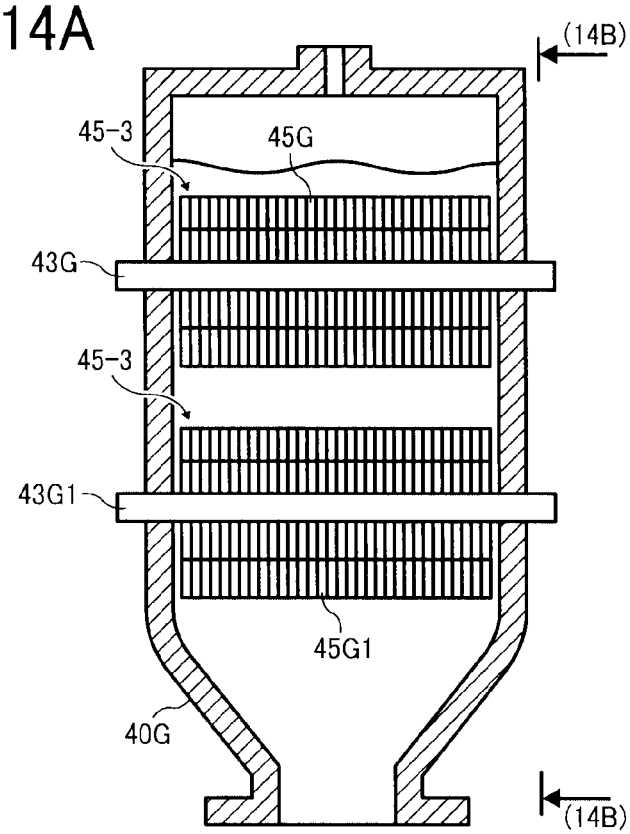
FIGS. 14A through 14C show lateral cross-sectional, end-on cross-sectional, and perspective views, respectively, of a structure of a developer container that includes multiple agitators respectively formed by linear members according to another embodiment.
Figure 14B:
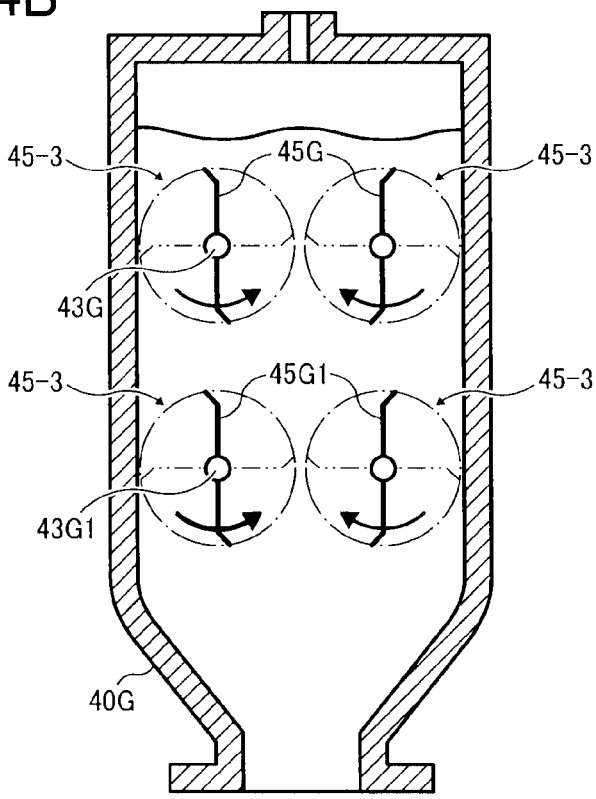
Figure 14C:
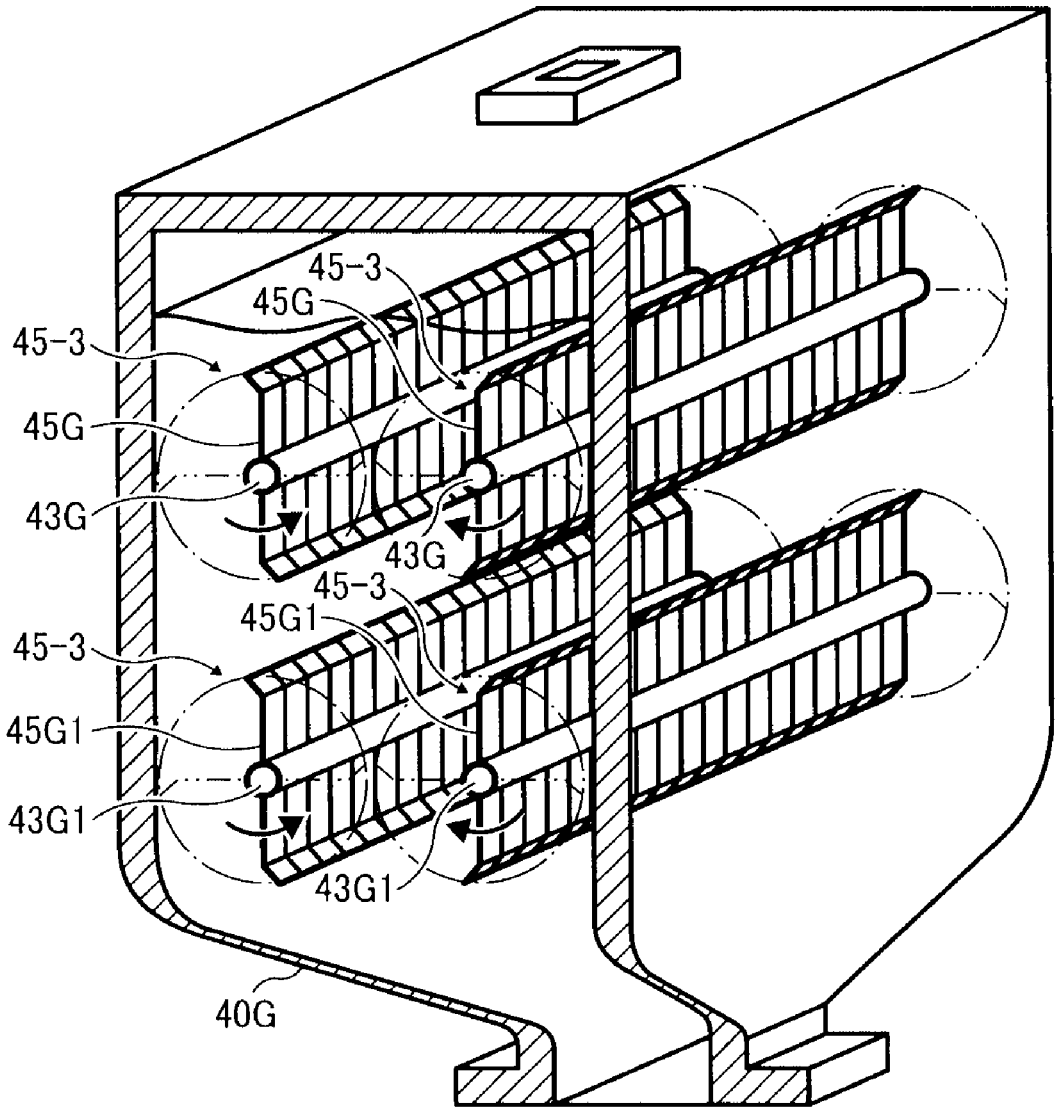

Next, another embodiment that uses multiple agitators whose rotary shafts are disposed at different portions from those in the above-described embodiments is described below with reference to FIGS. 14A-14C. FIGS. 14A through 14C show lateral cross-sectional, end-on cross-sectional, and perspective views, respectively, of a structure of a developer container that includes multiple agitators respectively formed by linear members according to another embodiment. FIG. 14B is a view along a line (14B)-(14B) shown in FIG. 14A, rotated 90 degrees from the view shown in FIG. 14A.

In this embodiment, as shown in FIGS. 14A and 14B, multiple agitators 45-3 whose rotary shafts 43G and 43G1 that extend in a direction perpendicular to the vertical are arranged in both a vertical direction and a horizontal direction in a developer container 40G. Thus, in the configuration shown in FIGS. 14A and 14B, there are four agitators 45-3, with the four stacked two high and two deep. In each agitator 45-3, linear members 45G and 45G1 are attached to the rotary shafts 43G and 43G1, respectively. The multiple agitators 45-3 serve as a first agitator and an additional agitator identical to the first agitator.

An upper surface of the developer container 40G is rectangular or square, that is, in cross-section, the developer container 40G is shaped as a rectangular parallelepiped, the lower end of which forms a funnel or upside down pyramid downwardly decreasing diameter. A supply port is provided in an upper portion of the developer container 40G and a discharge port is provided in a lower port thereof.

In the configuration shown in FIGS. 14A through 14C, the agitators 45-3 disposed next to each other in the horizontal direction rotate in opposite directions as indicated by arrows shown in FIG. 14B. The agitators 45-3 extending in the horizontal direction straddle the horizontal cross-sectional center of the developer container 40G, and therefore, as described above, the efficiency of agitating and mixing toner is enhanced in the horizontal center portion where the centrifugal force is weaker.

Additionally, the developer falling under its own weight through the developer container 40G is convected in the vertical direction by rotating the linear members 45G and 45G1 in opposite directions, and thus the efficiency of agitating and mixing developer is enhanced. Furthermore, because the developer is agitated by both gravity and the linear members 45G and 45G1 that can enhance agitation efficiency, the stress on the developer can be alleviated.

Moreover, because the horizontal cross section of the container 40G can be square or rectangular, the area given to the developer container 40G can be utilized more efficiently, and accordingly, the development device can be made even more compact.

Sixth Embodiment

Next, another embodiment is described with reference to FIGS. 15A through 15C. The configuration of the present embodiment is a variation of the configuration shown in FIGS. 14A and 14B. FIGS. 14A through 14C show horizontal cross-sectional, lateral cross-sectional, and perspective views, respectively, of a structure of a developer container that includes multiple agitators respectively formed by linear members according to another embodiment. In the configuration shown in FIGS. 15A through 15C, the multiple agitators 45-3 formed by the linear members 45H and 45H1 that extend in a direction perpendicular to the vertical, arranged horizontally, are located at different heights, and rotary shafts 43H of the upper agitators 45-3 are located perpendicular to the shafts 43H1 of the lower agitators 45-3.

Figure 15A:
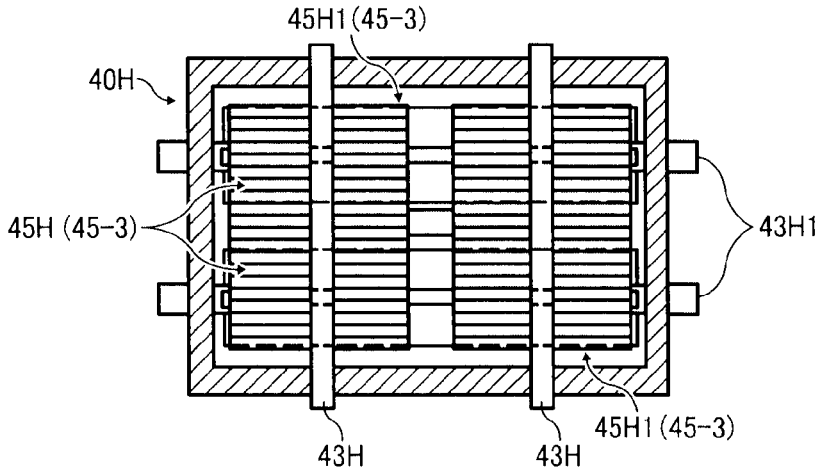
FIGS. 15A through 15C show a variation of the structure shown in FIGS. 14A through 14C.
Figure 15B:
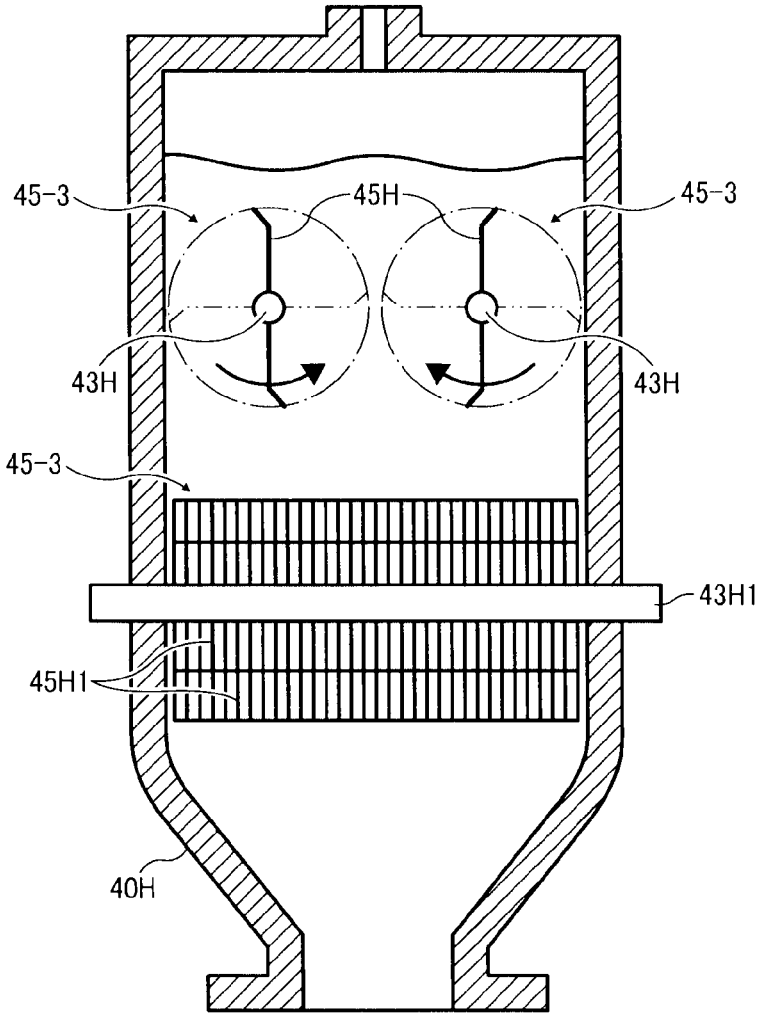
Figure 15C:
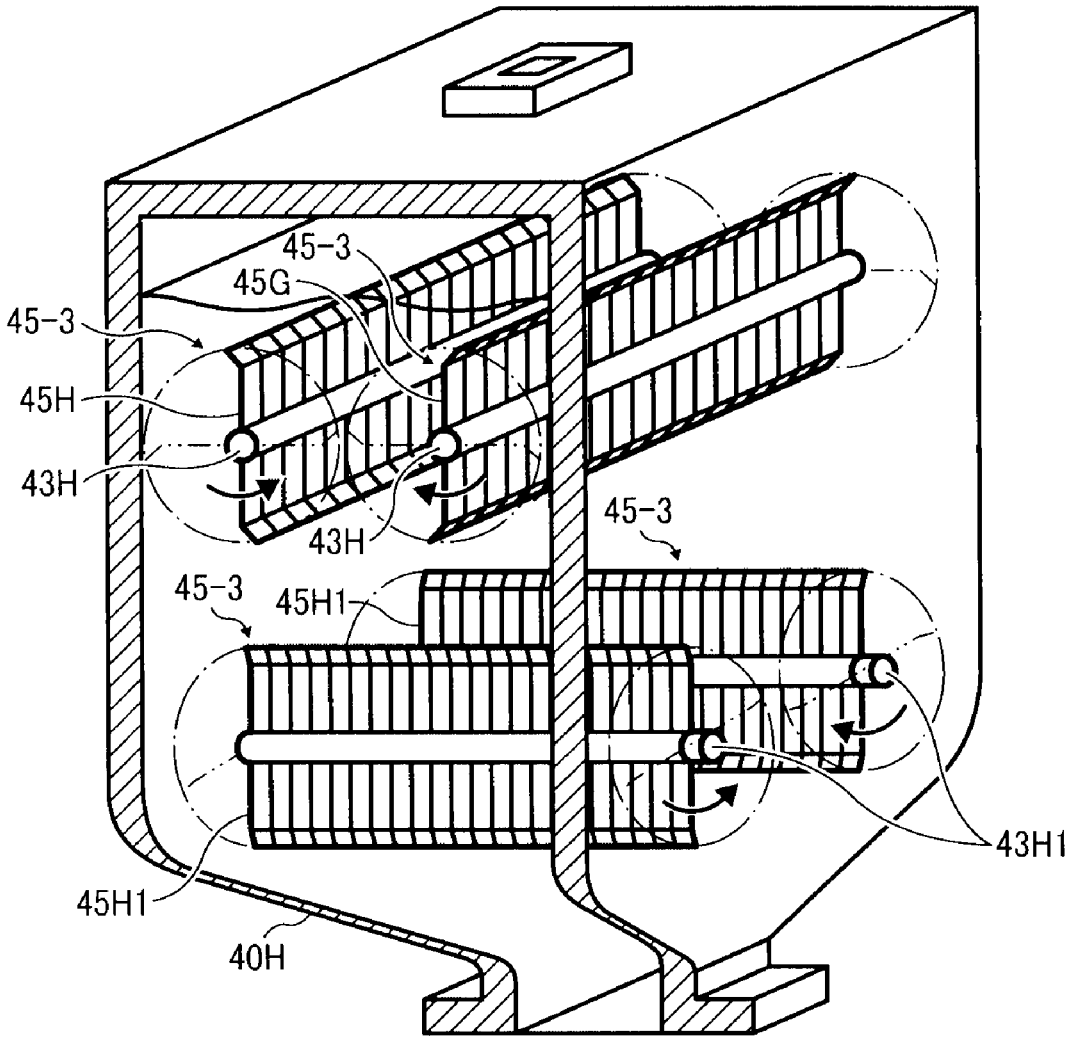

In the configuration shown in FIGS. 15A though 15C, the agitators 45-3 disposed next to each other in the horizontal direction rotate in opposite directions, as indicated by arrows shown in FIG. 15B. Additionally, the upper agitator 45-3 and the lower agitator arranged vertically rotate in different directions.

The rotary shafts 43H of the upper agitators 45-3 are located perpendicularly to the shafts 43H1 of the lower agitators 45-3 in the developer container 40H, and therefore, reduction in the agitation performance in a center portion in the horizontal direction of the developer container 40H can be restrained. Moreover, a more complex convection of the developer can be obtained, and accordingly efficiency of agitating and mixing the developer can be enhanced. Additionally, the developer being agitated and mixed can pass through the gaps between the respective linear members 45H and 45H1, and charging performance can be enhanced while keeping the stress on the developer low.

It is to be noted that, although in the above-described embodiments, the linear members are formed of a material, such as wire, whose shape is uniform, the shape of the linear members is not necessarily uniform. Alternatively, for example, when wire is used, bottom portions or cross-rails portions that connect together both sides of the portion of the linear members extending in the vertical direction may be made wider than the vertically extending portions, for example by flattening the wire.

In this configuration, because the widened portions can move the developer differently from the movement of the developer obtained when the developer moves through the gap between the wire linear members, the movement of agitating and mixing the developer becomes more complex, and accordingly the agitation performance can be enhanced. More specifically, the widened portions can, for example, scoop up or disperse the developer differently from the other portions of the linear members.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device, comprising:

a development portion to develop a latent image formed on a latent image carrying member with developer including toner and carrier particles;

a circulation unit to convey the developer collected from the development portion to the development portion, the circulation unit including a container to store the developer, disposed upstream from the development portion in a direction in which the developer is circulated; and a first agitator provided inside the container, to agitate and mix the collected developer and fresh toner supplied to the container, the first agitator comprising multiple linear members, wherein the multiple linear members forming the first agitator each comprise a vertical portion extending in substantially a vertical direction, with gaps between adjacent linear members in a horizontal direction perpendicular to the vertical direction;

the gaps in the horizontal direction are sized to allow the carrier particles included in the developer to pass through the gaps, and the linear members have a thickness that enables the linear members to move the toner as the linear members rotate through the toner; and wherein the container includes a lower, funnel-like portion of downwardly decreasing diameter, wherein a supply port is provided in an upper portion of the container and a discharge port is provided in a lower portion thereof, and the first agitator agitates the developer supplied from the supply port in a direction to impede movement of the developer falling downward by force of gravity.

2. The development device according to claim 1, wherein each of the linear members comprises a portion extending along a contour of an internal surface of the container without contacting the internal surface of the container.

3. The development device according to claim 2, wherein each of the linear members further comprises at least one horizontal portion to connect together the portions extending along the internal surface of the container.

4. The development device according to claim 1, wherein each of the linear members further comprises a horizontal portion extending substantially in the horizontal direction and connected to the vertical portions.

5. The development device according to claim 1, wherein each of the linear members presents an edgeless face in horizontal cross section on a front side in a direction of rotation of the linear members.

6. The development device according to claim 5, wherein the linear members have a round, rectangular, square, triangular, or diamond shape with rounded-off corners in the horizontal cross section.

7. A development device, comprising:

a development portion to develop a latent image formed on a latent image carrying member with developer including toner and carrier particles;

a circulation unit to convey the developer collected from the development portion to the development portion, the circulation unit including a container to store the developer, disposed upstream from the development portion in a direction in which the developer is circulated; and a first agitator provided inside the container, to agitate and mix the collected developer and fresh toner supplied to the container, the first agitator comprising multiple linear members, the development device further comprising a second agitator formed of one of a screw, a propeller, and a paddle, located inboard of the first agitator, wherein the first agitator rotates around a rotary shaft that extends vertically and is disposed in a center portion of the container, and the second agitator extends coaxially to the rotary shaft of the first agitator and is rotatable around the rotary shaft.

8. The development device according to claim 7, wherein the first agitator and the second agitator rotate in opposite directions.

9. The development device according to claim 7, wherein the first agitator is inclined so that its outer end portion farther from the rotary shaft is upstream from its inner end portion closer to the rotary shaft in the direction in which the first agitator rotates.

10. A development device, comprising:

a development portion to develop a latent image formed on a latent image carrying member with developer including toner and carrier particles;

a circulation unit to convey the developer collected from the development portion to the development portion, the circulation unit including a container to store the developer, disposed upstream from the development portion in a direction in which the developer is circulated; and a first agitator provided inside the container, to agitate and mix the collected developer and fresh toner supplied to the container, the first agitator comprising multiple linear members, the development device further comprising at least one additional agitator identical to the first agitator in the container.

11. The development device according to claim 10, wherein horizontally adjacent first agitator and the at least one additional agitator identical to the first agitator rotate in opposite directions.

12. The development device according to claim 10, wherein rotary shafts of the first agitator and the at least one additional agitator identical to the first agitator are horizontally offset from a horizontal center portion of the container.

13. The development device according to claim 10, wherein the linear members of the first agitator and the at least one additional agitator identical to the first agitator are provided on rotary shafts that extend vertically downward.

14. The development device according to claim 10, wherein the linear members of the first agitator and at least one additional agitator are provided on rotary shafts that extend in the horizontal direction.

15. The development device, according to claim 10, wherein the first agitator and the at least one additional agitator identical to the first agitator whose rotary shafts extend horizontally are stacked vertically.

16. An image forming apparatus, comprising:

a latent image carrying member to carry a latent image; and the development device of claim 1.

17. An image forming apparatus, comprising:

a latent image carrying member to carry a latent image; and the development device of claim 7.

18. An image forming apparatus, comprising:

a latent image carrying member to carry a latent image; and the development device of claim 10.

* * * * *